US012111103B2

(12) United States Patent
Brigden et al.

(10) Patent No.: US 12,111,103 B2
(45) Date of Patent: Oct. 8, 2024

(54) METHODS OF MANUFACTURING APPARATUS AND SYSTEMS FOR LIQUEFACTION OF NATURAL GAS

(71) Applicant: STEELHEAD LNG (ASLNG) LTD., Vancouver (CA)

(72) Inventors: Alex Brigden, Vancouver (CA); Angus Remfry, Vancouver (CA); Glen Cunial, Vancouver (CA); Tom Boguslawski, Vancouver (CA)

(73) Assignee: STEELHEAD LNG (ASLNG) LTD., Vancouver (CA)

( * ) Notice: Subject to any disclaimer, the term of this patent is extended or adjusted under 35 U.S.C. 154(b) by 0 days.

(21) Appl. No.: 18/603,128

(22) Filed: Mar. 12, 2024

(65) Prior Publication Data

US 2024/0263870 A1 Aug. 8, 2024

Related U.S. Application Data

(63) Continuation of application No. 17/050,253, filed as application No. PCT/CA2018/050662 on Jun. 1, 2018, now Pat. No. 11,959,700.

(51) Int. Cl.

| | |
|---|---|
| ***F25J 1/00*** | (2006.01) |
| ***B63B 39/03*** | (2006.01) |
| ***F25J 1/02*** | (2006.01) |

(52) U.S. Cl.

CPC ..... *F25J 1/0022* (2013.01); *B63B 39/03* (2013.01); *F25J 1/004* (2013.01); *F25J 1/0278* (2013.01);

(Continued)

(58) Field of Classification Search

CPC .. F25J 1/00; F25J 1/0022; F25J 1/0278; F25J 1/004; B63B 39/00; B63B 39/03

(Continued)

(56) References Cited

U.S. PATENT DOCUMENTS 4,067,284 A 1/1978 Yasushi et al.
4,545,795 A 10/1985 Liu et al.

(Continued)

FOREIGN PATENT DOCUMENTS

AU 2012207058 A1 8/2012
AU 2012207059 A1 8/2012

(Continued)

OTHER PUBLICATIONS

50th Anniversary of First Commercial LNG Tanker, The Maritime Executive, 2019, 3 pages.

(Continued)

*Primary Examiner* — Lars A Olson
(74) *Attorney, Agent, or Firm* — Kilpatrick Townsend & Stockton LLP

(57) ABSTRACT

Described herein are methods of manufacturing an at-shore water-based apparatus for liquefaction of natural gas. In some cases, the methods can include determining a weight of an air-cooled electrically driven refrigeration system ("AER System"); locating a ballast medium in a hull where the ballast medium has a simulated weight approximate to the weight of the AER System; determining a deflection of the hull caused by the simulated weight; moving the ballast medium off the hull while attaching the AER System; assembling a plurality of liquefied natural gas ("LNG") storage tanks in the hull; and coupling the AER System with the LNG storage tanks. The ballast medium can be moved off the hull such that the weight of the ballast medium supported by the hull is reduced in order to maintain the deflection of the hull while the AER System is attached.

29 Claims, 8 Drawing Sheets

(52) U.S. Cl.
CPC ..... *F25J 2220/64* (2013.01); *F25J 2245/02* (2013.01)

(58) Field of Classification Search
USPC ..... 114/121
See application file for complete search history.

(56) References Cited

U.S. PATENT DOCUMENTS

| | | | |
|---|---|---|---|
| 4,885,591 | A | 12/1989 | Page |
| 5,299,520 | A | 4/1994 | Wilts |
| 5,916,260 | A | 6/1999 | Dubar |
| 6,089,022 | A | 7/2000 | Zednik et al. |
| 6,786,166 | B1 | 9/2004 | Marchand et al. |
| 6,889,522 | B2 | 5/2005 | Prible et al. |
| 6,997,643 | B2 | 2/2006 | Wille et al. |
| 7,114,351 | B2 | 10/2006 | Jones, Jr. et al. |
| 7,119,460 | B2 | 10/2006 | Poldervaart et al. |
| 7,318,319 | B2 | 1/2008 | Hubbard et al. |
| 7,552,256 | B2 | 6/2009 | Ellerbrock et al. |
| 8,006,724 | B2 | 8/2011 | Hartono et al. |
| 8,147,302 | B2 | 4/2012 | Desrochers et al. |
| 8,308,518 | B1 | 11/2012 | Shivers et al. |
| 8,464,551 | B2 | 6/2013 | Roberts et al. |
| 8,490,563 | B1 | 7/2013 | Shivers |
| 8,646,289 | B1 | 2/2014 | Shivers, III et al. |
| 9,199,700 | B2 | 12/2015 | Fargier et al. |
| 9,422,037 | B2 | 8/2016 | Van Wijngaarden et al. |
| 9,493,216 | B2 | 11/2016 | Scott et al. |
| 9,562,717 | B2 | 2/2017 | Kim et al. |
| 9,593,881 | B2 | 3/2017 | Nelson et al. |
| 9,863,697 | B2 | 1/2018 | Roberts |
| 9,879,906 | B2 | 1/2018 | Van Aken |
| 9,933,119 | B2 | 4/2018 | Bernays et al. |
| 10,065,719 | B1 | 9/2018 | Hoover |
| 10,260,679 | B2 | 4/2019 | Wyllie et al. |
| 11,959,700 | B2 * | 4/2024 | Brigden ..... F25J 1/004 |
| 2003/0226373 | A1 | 12/2003 | Prible et al. |
| 2005/0193937 | A1 | 9/2005 | Freelund et al. |
| 2005/0204625 | A1 | 9/2005 | Briscoe et al. |
| 2006/0156744 | A1 | 7/2006 | Cusiter et al. |
| 2008/0127673 | A1 | 6/2008 | Bowen et al. |
| 2009/0281686 | A1 | 11/2009 | Smith et al. |
| 2010/0135825 | A1 | 6/2010 | Walth |
| 2010/0263406 | A1 | 10/2010 | Dam et al. |
| 2010/0281915 | A1 | 11/2010 | Roberts et al. |
| 2011/0236226 | A1 | 9/2011 | Van De Lisdonk et al. |
| 2011/0297346 | A1 | 12/2011 | Minta et al. |
| 2012/0047942 | A1 | 3/2012 | Kolodziej |
| 2014/0369765 | A1 | 12/2014 | Fargier et al. |
| 2015/0075216 | A1 | 3/2015 | Van et al. |
| 2015/0107247 | A1 | 4/2015 | Lou et al. |
| 2015/0176880 | A1 | 6/2015 | Ochiai et al. |
| 2016/0010916 | A1 | 1/2016 | Byfield |
| 2016/0046354 | A1 | 2/2016 | Scott et al. |
| 2016/0116209 | A1 | 4/2016 | Nagao et al. |
| 2016/0214687 | A1 | 7/2016 | Van Wijngaarden et al. |
| 2016/0231050 | A1 | 8/2016 | Faka |
| 2016/0369780 | A1 | 12/2016 | Aubault et al. |
| 2017/0074558 | A1 | 3/2017 | Christensen et al. |
| 2017/0167787 | A1 | 6/2017 | Pierre, Jr. et al. |
| 2017/0292077 | A1 | 10/2017 | Young et al. |
| 2018/0231303 | A1 | 8/2018 | Pierre, Jr. |
| 2018/0320637 | A1 | 11/2018 | Lee et al. |
| 2019/0118907 | A1 | 4/2019 | Larson et al. |
| 2019/0193817 | A1 | 6/2019 | Carroll et al. |
| 2020/0309450 | A1 | 10/2020 | Morley et al. |

FOREIGN PATENT DOCUMENTS

| | | | |
|---|---|---|---|
| CA | 2130890 | A1 | 2/1996 |
| CA | 2393198 | C | 12/2008 |
| CA | 2809377 | A1 | 3/2012 |
| CA | 2794218 | A1 | 2/2014 |
| CA | 2882326 | A1 | 10/2014 |
| CA | 2935657 | A1 | 7/2015 |
| CN | 101520127 | A | 9/2009 |
| CN | 101704404 | A | 5/2010 |
| CN | 102050208 | A | 5/2011 |
| CN | 102388200 | A | 3/2012 |
| CN | 102582796 | A | 7/2012 |
| CN | 106595220 | A | 11/2014 |
| CN | 203921155 | U | 11/2014 |
| CN | 105190210 | A | 12/2015 |
| CN | 2015121271 | A | 12/2015 |
| CN | 107228275 | A | 10/2017 |
| EP | 2623414 | A1 | 8/2013 |
| EP | 3053822 | A1 | 8/2016 |
| GB | 1596330 | A | 8/1981 |
| KR | 20150139874 | A | 12/2015 |
| KR | 20160029383 | A | 3/2016 |
| KR | 20160076620 | A | 7/2016 |
| KR | 101652253 | B1 | 8/2016 |
| KR | 20160121127 | A | 10/2016 |
| KR | 20170136266 | A | 12/2017 |
| KR | 2018-0011343 | A | 1/2018 |
| WO | 2007064209 | A1 | 6/2007 |
| WO | 2010069910 | A2 | 6/2010 |
| WO | 2010112909 | A2 | 10/2010 |
| WO | 2011032958 | A1 | 3/2011 |
| WO | 2011039279 | A2 | 4/2011 |
| WO | 2013156623 | A1 | 10/2013 |
| WO | 2014173597 | A2 | 10/2014 |
| WO | 2015039169 | A1 | 3/2015 |
| WO | 2015110443 | A2 | 7/2015 |
| WO | 2015140197 | A2 | 9/2015 |
| WO | 2016187645 | A1 | 12/2016 |
| WO | 2018214232 | A1 | 11/2018 |
| WO | 2019008107 | A1 | 1/2019 |

OTHER PUBLICATIONS

Analysis on Woodfibre LNG Limited's Report Pursuant to Conditions 2.10 and 2.11 of the Decision Statement, Woodfibre LNG Project, Feb. 2018, 35 pages.

Application for a Licence to Export Liquefied Natural Gas to the National Energy Board, Orca LNG Ltd.'s.

Application for an Amendment to Environmental Assessment Certificate #E15-02, Woodfibre LNG Limited, Jan. 2017, 129 pages.

Black & Veatch PRICO SMR Becomes World's First Proven FLNG Technology to Achieve Production on Floating Facility, Published by the EconoTimes.

Black & Veatch PRICO SMR Becomes World's First Proven FLNG Technology to Achieve Production on a Floating Facility, Publishsoft, Oct. 20, 2016, 4 pages.

Brochure titled World-Class LNG Capabilities, Delivering Clean Energy and Proven LNG Solutions, Published by Black & Veatch.

Canadian Patent Application No. 3027085, Office Action dated Jan. 15, 2020.

Canadian Patent Application No. 3027085, Office Action dated Feb. 11, 2020.

Canadian Patent Application No. 3027085, Office Action dated Sep. 9, 2019.

Competitive at-Shore FLNG Solutions, Riviera Newsletters, Available Online at: https://www.rivieramm.com/news-content-hub/news-content-hub/competitive-at-shore-flng-solutions-29464, Mar. 9, 2017, pp. 1-7.

Douglas Channel Energy Project—LNG and North America Natural Gas Market Assessment, Wood Mackenzie, 29 pages.

Douglas Channel LNG, Exmar, Available Online at: http:/douglaschannellng.com/, Jan. 30, 2020, 1 page.

Douglas Channel—Small Scale LNG Facility Project Description, BC LNG Export Licence Application Schedule D—LNG Facility Project Overview and Description, Dec. 2010, 46 pages.

Early FLNG Projects Deal with Technical and Execution Challenges, Available Online at: https://www.offshore-mag.com/rigs-vessels/article/16757281/early-flng-projects-deal-withtechnical-and-execution-challenges, May 5, 2014, 9 pages.

Environmental Assessment Certificate Application—LNG Canada Export Terminal, Section 2: Project Overview, Oct. 2014, 86 pages.

(56) References Cited

OTHER PUBLICATIONS

Environmental Impact Assessment and Environmental Management Plan for the Development of Bulk Liquid Berth, Project Code: 484061314 for Karaikal Port Private Limited (KPPL) Karaikal, Nov. 2016, 411 pages.
Excelerate Energy—Efficient and Cost-Effective Solutions for the Global Gas Market, Excelerate Energy L.P., Jan. 14, 2014, 40 pages.
Excelerate Energy—Pursuing the Next Wave, Excelerate Energy L.P., 2013 FLNG Conference, Jun. 11, 2013, 12 pages.
Excelerate Energy's Floating LNG Solutions, Excelerate Energy L.P., Jun. 10, 2014, 22 pages.
Excelerate Liquefaction Solutions I, Federal Register, vol. 78, No. 48, Mar. 12, 2013, pp. 15715-15718.
Executing FLNG Projects—Technical Challenges from Development to Start-Up—Floating LNG, KBR, Sep. 2016, 17 pages.
Federal Court Decision Between Steelhead (ASLN) LTD . . . and ARC Resources, Ltd., Date Dec. 13, 2023, Docket T-1488-20, Citation No. 2023 FC 1684, 101 pp.
FLNG—Determining the Technical and Commercial Boundaries, Paper PS2-4, pp. 1-18.
FLNG Get Serious, Gas Today, Aug. 2010, 2 pages.
FLNG—Towards a Natural Gas Future on the High Seas, Oil & Gas IQ E-Book, Apr. 2015, 13 pages.
Floating Liquefied Natural Gas, Handbook of Liquefied Natural Gas, 2014, pp. 1-21.
Floating LNG Production, The Linde Group, Available Online at: https://www.linde-engineering.com/en/images/LNG_3_4_e_12_150dpi_NB_tcm19-19967.pdf, pp. 1-12.
Freeport LNG Liquefaction Project Phase II Modification Project Final Environmental Impact Statement, Jun. 2014, Federal Energy Regulatory Commission Office of Energy Projects, https://www.energy.gov/sites/prod/files/2015/01/f19/EIS-0487-FERC-FEIS-2014_0.pdf.
GTT Membrane Cargo Containment Systems, Jun. 2015, GTT Training Ltd./GTT, https://www.onthemosway.eu/wp-contant/uploads/2015/06/GTT-Training-Membrane-Tanks.compressed.pdf (Note Jun. 2015 upload date).
LNG Emissions Benchmarking, Delphi Group, Environmental Strategies, Business Solutions, Mar. 2013, 38 pages.
LNG Solution Provider Presentation, Wison OffShore and Marine Ltd., Mar. 2015, pp. 1-23.
LNG Supply Chain, Yokogawa, 2005, 9 pages.
Offshore (FPSO FLNG & FSRU), Yokogawa Electric Corporation, Available Online at: https://www.yokogawa.com/industries/oil-gas/offshore-tpso-flng-fsru/, Mar. 16, 2020, pp. 1-6.
Oil and Gas Floating Production Solutions, KongsBerg Maritime, Intelligent Solutions for Production, Mar. 2014, pp. 1-24.
Our Projects: Shell Prelude FLNG: A New Reference in Offshore Safety and Quality, Published by Technip.
Outline Specification of a 7,500 m3 LNG Tanker for Bunkering and Short Sea, Published by Leissner Maritime.
Petronas FLNG Satu—Engineering and Delivering Malaysias First FLNG, TechnipFMC, 2017, pp. 1-8.
Petronas FLNG Satu—Engineering and Delivering Malaysias First FLNG—2, TechnipFMC, 2017, pp. 1-8.
Prelude Floating LNG Project—EIS Supplement—Response to Submissions, Shell Development Proprietary Limited, Jan. 2010, 45 pages.
Process Control, published in Mineral Processing Design and Operations, 2nd edition, 2016.
PROW Steelhead LNG Handout 1, Presentation re Saanich Inlet Development , Accompanying email from D. Tonken, Published by Steelhead LNG.
Shell Prelude FLNG—A New Landmark in the Offshore Industry, Technip/Samsung Consortium, Apr. 18, 2019, 8 pages.
Squamish Nation Announces Decision on Woodfibre LNG Plant Cooling Technology, Woodfibre LNG.
WCC LNG, Exxon Mobil, Imperial, Jan. 8, 2015, 142 pages.
Woodfibre LNG Commits to Electric Power, Woodfibre LNG.
Yokogawa in the LNG Supply Chain, Yokogawa brochure.
U.S. Appl. No. 17/050,253, Third-Party Submission, filed Sep. 17, 2021, 3 pages.
U.S. Appl. No. 17/050,253, Third-Party Submission, filed Mar. 25, 2022, 3 pages.
U.S. Appl. No. 17/050,253 , Advisory Action, Mailed on Oct. 5, 2023, 5 pages.
U.S. Appl. No. 17/050,253 , Final Office Action, Mailed on Jul. 5, 2023, 19 pages.
U.S. Appl. No. 17/050,253 , Non-Final Office Action, Mailed on Dec. 28, 2022, 19 pages.
U.S. Appl. No. 17/050,253 , Notice of Allowance, Mailed on Feb. 14, 2024, 8 pages.
Aronsson , "FLNG Compared to LNG Carriers—Requirements and Recommendations for LNG Production Facilities and Re-Gas Units", Department of Shipping and Marine Technology, Chalmers University of Technology, 2012, 61 pages.
Bell , "LNG Overview", BC Hydro Regeneration, Feb. 17, 2012, 11 pages.
Bolton , "Correction Elements", published in Instrumentation and Control Systems, 2nd edition, 2015.
Bukowski et al., "Innovations in Natural Gas Liquefaction Technology for Future LNG Plants and Floating LNG Facilities," Air Products and Chemicals Inc.—International Gas Union Research, 2011, pp. 1-15.
Cameron et al., "Applications of Radioisotope Instruments in Industry", Published in Radioisotope Instruments, 1971.
Chadwick , "Prelude Floating LNG Project—Draft Environmental Impact Statement", Shell Development Proprietary Limited, Oct. 2009, 316 pages.
Chiu et al., "Commercial and Technical Considerations in the Developments of Offshore Liquefaction Plant", 23rd World Gas Conference, Jun. 5-9, 2006, pp. 1-19.
Chiu , "History of the Development of LNG Technology", Published by Chevron Energy Technology Company, and Presented at AIChE Annual Conference, Nov. 18, 2008, 5 pages.
Clark , "FLNG Technical Challenges", Lloyd Warwick International, Sep. 17-20, 2017, pp. 1-35.
Corneliussen et al., "Near Shore FLNG Concept Evaluations", Norwegian University of Science and Technology, Department of Energy and Process Engineering, Jun. 2015, pp. 1-169.
Crozier , "Fibre—Wifi keep Most Shell Prelude Staff Onshore", Available Online at: https://www.itnews.com.au/news/fibre-wi-fi-keep-most-shell-prelude-staff-onshore-459383, Apr. 24, 2017, 12 pages.
Devold et al., "All Electric LNG Plants—Better, Safer, More Reliable—And Profitable", Published by ABB AS, 2006, 8 pages.
Devold , "Oil and Gas Production Handbook—An Introduction to Oil and Gas Production Transport Refining and Petrochemical Industry", Edition 3.0 Oslo, Aug. 2013, pp. 1-162.
Du et al., "An Experimental Investigation on Air-Side Performances of Finned Tube Heat Exchanges for Indirect Air-Cooling Tower", Thermal Science, vol. 18, No. 3, Jan. 2014, pp. 863-874.
Finn , "Floating Liquefaction Nearshore", LNG Industry, Oct. 29, 2020, 4 pages.
Foglietta et al., "LNG FPSO: Turboexpander Process Economics, Monetizing the "Gas Problem"", Published by ABB Lummus Global Inc., and Presented at the 84th GPA Annual Convention, Mar. 13-16, 2005.
Galar et al., "Data and Information Fusion From Disparate Asset Management Sources", published in eMaintenance, 2017.
Houari , "SG1 FLNG Report", IGU LNG Committee 2015-2018, Jun. 2018, 65 pages.
Houwer , "Floating LNG—Revolution and Evolution for the Global Industry?", KPMG Global Energy Institute, Available Online at: https://assets.kpmg/content/dam/kpmg/pdf/2014/11/floating-LNG-evolution-and-revolution-for-the-global-industry.pdf, Apr. 18, 2019, 24 pages.
Iverson et al., "Intsok Floating Production Event," Oslo, 2014, pp. 1-19.
Jingde Li et al., "Gas Dispersion Risk Analysis of Safety Gap Effect on the Innovating FLNG Vessel with a Cylindrical Platform," Journal of Loss Prevention in the Process Industries, Science Direct, 2016 vol. 40, pp. 314-316.

(56) References Cited

OTHER PUBLICATIONS

Joshi et al., "Advanced Machining Technologies", published in Comprehensive Materials Processing, 2014.
Kleiner et al., "All Electric Driven Refrigeration Compressors in LNG Plants Offer Advantages", Published by Siemens AG and Shell Development, and Presented at Gastech Conference 2005, 2005, 10 pages.
Larsen , "Floating LNG—Near shore FLNG Solutions—Project Assessment Criteria and Cost", Hoegh FLNG Ltd., pp. 1-15.
Luisi , "Process Control System", Pragmatic Enterprise Architecture, 2014, 13 pages.
Miller , "New FLNG Vessels Present Challenges in Building, Automation", OffShore, Jun. 10, 2015, pp. 1-9.
Mokhatab et al., "Develop Successful Nearshore FLNG Solutions—Part 2—Natural Gas Liquefaction", Gas Processing & LNG, Accessed from Internet on Oct. 29, 2020, 6 pages.
Mokhatab et al., "Handbook of Liquefied Natural Gas", Gulf Professional Publishing (Elsevier).
Mokhatab et al., "Handbook of Liquefied Natural Gas", Chapter 6—Process Control and Automation of LNG Plants and Import Terminals, Mar. 2, 2020, 40 pages.
Mokhatab , "Nearshore FLNG Enables New Opportunities", Gas Processing & LNG, Accessed from Internet on Jan. 30, 2020, pp. 1-3.
Mokhatab et al., "Process Control Fundamentals", published in Handbook of Natural Gas Transmission and Processing, 2012.
Noble , "A Short History of LNG Shipping 1959-2009", Texas Section—SNAME, Feb. 10, 2009, 32 pages.
Parr , "Programmable Controllers", Published in Electrical Engineer's Reference Book, 16th edition, 2003.
Application No. PCT/CA2018/050662 , International Preliminary Report on Patentability, Mailed on Aug. 21, 2020, 21 pages.
Application No. PCT/CA2018/050662 , International Search Report and Written Opinion, Mailed on May 9, 2019, 13 pages.
Pettersen et al., "Technical and Operational Innovation for Onshore and Floating LNG", Published by Statoil, and Presented at the 17th International Conference & Exhibition on Liquefied Natural Gas (LNG 17, Houston), Apr. 19, 2013, 17 pages.
Poe et al., "Process Control", published in Modeling, Control, and Optimization of Natural Gas Processing Plants, 2017.
Price et al., "Developing Small-Scale LNG Plants", Gas Today, Issue 13, 2010, pp. 18-22.
Rans et al., LNG Vapor Cloud Dispersion with Water Spray Curtain, p. 1, Oct. 28-29, 2008, http://pscmembers.tamu.edu/wp-content/upload/55-rana-morshed.pdf.
Rivot et al., "Experimental Tests and Qualification of a CFD Simulation Tool for Cryogenic Release Modelling through the JIP "FLNG Cryogenic Spillage Protection"", Published by Technip, and presented at the Gas Processors Association of Europe (GPAe), Sep. 13-15, 2017.
Ruiwale et al., "A Review on Floating Liquefied Natural Gas Carriers", International Journal of Current Engineering and Technology, Mar. 2017, pp. 298-305.
Songhurst , "Floating Liquefaction (FLNG)—Potential for Wider Deployment", The Oxford Institute for Energy Studies, Nov. 2016, 38 pages.
Songhurst , "The Latest FLNG Developments", FLNG Conference, Jun. 11, 2013, 23 pages.
Songhurst , "The Outlook for Floating Storage and Regasification Units (FSRUs)", The Oxford Institute for Energy Studies (University of Oxford), Jul. 2017, 54 pages.
Suarez , "Has the Time Come for Floating All-Electric LNG?", OffShore, Jul. 16, 2014, pp. 1-12.
Sullivan , "Floating LNG—Origins and Future Impact on the LNG Industry", Available Online at: https://www.spegcs.org/files/11546, Jul. 13, 2016, 27 pages.
Sullivan, Paul, Evolution of AtShore LNG (ASLNG) Concept; FLNG World Congress, Jun. 21, 2017, 23 pp.
Talib et al., "B & V Pushes Forward With Barge-Based LNG Production Concept for Small and Mid-Scale", LNG Journal, Mar. 2013, pp. 18-23.
Talib et al., "Development of Floating LNG Production Units with Modular/Scalable SMR Processes", OTC 21976, Published by Black & Veatch at the Offshore Technology Conference, May 2-5, 2011.
Talib et al., "Flexibility is Critical for Floating LNG Operations", Published at www.LNGWorldShipping.com.
Talib et al., "Flexibility is Key to FLNG Project Success", Gas Processing & LNG is Produced by Gulf Publishing Holdings LLC, Nov. 3-6, 2020, 8 pages.
Talib, J. et al., "Flexibility is key to FLNG project success," Gas Processing, Mar. 2014, 6 pp.
Talib et al., "LNG Barge Developments Move Forward", GasTech, Oct. 8-11, 2012, 16 pages.
Talib et al., "LNG Barges—The Offshore Solution for Export of US Pipeline Gas", OffShore Technology Conference, OTC 23939, 2013, pp. 1-16.
Talib et al., "What Makes Nearshore Midscale FLNG Solutions Attractive", Published by Black & Veatch at the Gastech Conference, Oct. 2015.
Thuncher , "Sea-Cooling System Out, Air-cooling System in", Published in The Squamish Chief.
Verghese , "FLNG Offshore and Nearshore", Published by Advisian, WorleyParsons Group, Apr. 2016.
Verghese , "FLNG Offshore and Nearshore- Contrasting Architectures Technology Drivers and Commercialization Challenges", Advisian, Apr. 2016, 18 pages.
Verghese , "Will At-Shore FLNG Drive Low Cost Monetization and Export of Pipeline Gas? An Examination of Concept Features, Opportunities and Challenges", OTC-28985-MS, Published by Advisian, WorleyParsons Group, and presented at the Offshore Technology Conference, Apr. 30-May 3, 2018.
Won et al., "Current Trends for the Floating Liquefied Natural Gas (FLNG) Technologies", Korean Journal of Chemical Engineering, vol. 31, 2014, pp. 1-12.
Zhang et al., "Industrial Control System Simulation Routines", Published in Advanced Industrial Control Technology, 2010.
The U.S. Appl. No. 18/582,449 , "Non-Final Office Action", mailed Jun. 12, 2024, 12 pages.
The U.S. Appl. No. 18/603,139 , "Non-Final Office Action", mailed May 15, 2024, 52 pages.
The U.S. Appl. No. 18/625,069 , "Non-Final Office Action", mailed Jul. 1, 2024, 37 pages.
A.J. Mazon et al., "Gap-type Conductors: Influence of high temperature in the Compression Clamp Systems," IEEE Bologna Power Tech Conference, Jun. 23-26, 2003, p. 90-94, 5 pages.
Jorge Borroy Vicente, "Electric conductors in transmission lines," Engineering area of Abengoa Inabensa, pp. 96-98, May 24, 2016, 3 pages.
Suntanu Dalal et al., "New eDrive electricity rate for LNG facilities," Ministry of Energy & Mines, BC Hydro Media Relations, p. 100-101, Nov. 4, 2016, 2 pages.
Saeid Mokhatab et al., "Handbook of Liquefied Natural Gas," Gulf Professional, Elsevier, pp. 103-105, 2014, 3 pages.
Min Cheol Ryu et al., "Sloshing design load prediction of a membrane type LNG cargo containment system with two-row tank arrangement in offshore applications," International Journal of Naval Architecture and Ocean Engineering, pp. 1-17, Jun. 13, 2016.
The Canadian Application No. 3,097,848, "Filing of Protest,": mailed Jun. 10, 2024,93 pages.

* cited by examiner

METHODS OF MANUFACTURING APPARATUS AND SYSTEMS FOR LIQUEFACTION OF NATURAL GAS

CROSS-REFERENCE TO RELATED APPLICATIONS

The present application is a continuation of U.S. application Ser. No. 17/050,253, filed Oct. 23, 2020, which is a national phase application under 35 U.S.C. § 371 of International application No. PCT/CA2018/050662, filed Jun. 1, 2018, the contents of which are hereby incorporated by references herein in their entireties.

TECHNICAL FIELD

This disclosure relates to liquefaction apparatus, methods, and systems.

BACKGROUND

Natural gas reserves exist throughout the world. Some reserves are located far from high demand markets, such as the United States, requiring specialized vessels to transport the gas from reserve to market. It may be cheaper and easier to transport the gas in liquid form. For example, it is common to liquefy the natural gas on land proximate to the reserve and transport the liquefied natural gas (or "LNG") long distances over water using an LNG carrier vessel. Land-based liquefaction is not always possible. For example, a significant amount of natural gas exists in deep-water reserves situated under remote bodies of water, without any land proximate thereto. Water-based liquefaction is desirable in these instances. Floating liquefied natural gas facilities have been used to liquefy natural gas from deep-water reserves. One example is the Prelude FLNG, currently the world's largest vessel. Another significant amount of natural gas exists in shallow waters inaccessible to large, oceangoing vessels like the Prelude. Improvements are required to use water-based liquefaction in these waters.

SUMMARY

One aspect of this disclosure is a system for at-shore liquefaction. This system may comprise: a source of electricity and preprocessed feed gas and a water-based apparatus. The water-based apparatus may comprise: an air-cooled electric refrigeration module ("AER Module") configured to input electricity and preprocessed feed gas from the source, convert the preprocessed feed gas into a liquefied natural gas ("LNG"), and output the LNG; and a plurality of LNG storage tanks configured to input the LNG from the AER Module, and output the LNG to an LNG transport vessel.

In some aspects, the source may generate the preprocessed feed gas by removing unwanted elements. For example, the unwanted elements may include at least heavy hydrocarbons. The AER Module may convert a portion of the preprocessed feed gas into a fuel gas, and output the fuel gas to the source. For example, the source may generate a portion of the electricity; and may comprise a gas-powered generator configured to generate the portion of the electricity with the fuel gas. One of a port side or a starboard side of the water-based apparatus may be moorable to an at-shore anchor structure. For example, the one of the port side or the starboard side may be engageable with a walkway structure. The water-based apparatus may comprise a containment system configured to direct cryogenic spills over the other one of the port side or the starboard side.

The electricity input from the source may be equal or greater than approximately 100 kV and approximately 220 MW. For example, the electricity may be input from the source with a line including one or more conductors, and the system may further comprise a transit bridge extendable between the water-based apparatus and the source to support the line. The water-based apparatus may comprise a closed loop ballast system operable with a ballast fluid to stabilize the water-based apparatus without discharging the ballast fluid. In some aspects, the AER Module may comprise one or more refrigeration trains comprising electric compressors, air coolers, and knock-out drums. For example, the one or more refrigeration trains may be configured to perform a dual-mixed refrigeration process.

The system may comprise a controller operable with the source and the water-based apparatus and/or a plurality of sensors comprising sensors of the source and sensors of the water-based apparatus. For example, the controller may operate the AER Module and at least a power supply component at the source based on data output from the sensors of the water-based apparatus and the sensors of the source. As a further example, the controller may comprise one or more devices located remotely from the water-based apparatus and the source. The plurality of LNG storage tanks comprise a single row of tanks spaced apart along a centerline axis of the hull. In some aspects, the water-based apparatus may not comprise a primary power generation system or a gas preprocessing system.

Another aspect is a water-based apparatus for at-shore liquefaction. This apparatus may comprise: an air-cooled electric refrigeration module ("AER Module") on or above an upper deck of the water-based apparatus and configured to input electricity and preprocessed feed gas from a source, convert the preprocessed feed gas into a liquefied natural gas ("LNG"), and output the LNG; and a plurality of LNG storage tanks in a hull of the water-based apparatus and configured to input the LNG from the AER Module, and output the LNG to an LNG transport vessel.

The preprocessed gas may exclude at least heavy hydrocarbons and/or the electricity may be equal or greater than approximately 100 kV and approximately 220 MW. All of the LNG may be routed into the hull from the AER Module and out of the hull from the plurality of LNG storage tanks. The apparatus may further comprise an output port in a central portion of the apparatus to output the LNG to the LNG transport vessel. For example, the plurality of LNG storage tanks may comprise a single row of tanks spaced apart along a centerline axis of the hull; and a storage volume of each tank in the single row of tanks is approximately centered on the centerline axis. As a further example, each tank of the plurality of LNG tanks may be a membrane tank, and the storage volume of each membrane tank may comprise an irregular cross-sectional shape that may be defined by inner portions of the hull and/or centered on the centerline axis.

According to this disclosure, the water-based apparatus may further comprise a gas collection and distribution system on the water-based apparatus to: input a first gas from the AER Module and a second gas from the plurality of LNG storage tanks; and output the first gas and the second gas to a compressor. The first gas may be different from the second gas. In some aspects, the fuel gas distribution system may be configured to input a third gas from the LNG transport vessel. The second gas and the third gas may be boil-off gas. The apparatus also may comprise a plurality of sensors configured to detect cryogenic spills and leaks of flammable gas. As a further example, the apparatus may comprise: channels above the hull to collect the cryogenic spills; downcomers in communication with the channels to direct the cryogenic fluid over and away from one side of the hull; and nozzles to spray exterior surfaces of the one side of the hull with a protective fluid in response to the plurality of sensors.

For stability, the water-based apparatus may comprise a closed loop ballast water system comprising: a plurality of ballast tanks below the upper deck; and one or more pumps configured to move a ballast fluid between the plurality of ballast tanks without discharging any of the ballast fluid to the environment. The AER Module may comprise one or more refrigeration trains comprising electric compressors and air coolers. For example, the one or more refrigeration trains comprise: a first refrigeration train configured to receive a first portion of the preprocessed feed gas and output a first portion of the LNG; and a second refrigeration train configured to receive a second portion of the pre-preprocessed feed gas and output a second portion of the LNG, wherein the first refrigeration train is independent of the second refrigeration train. Each train of the one or more refrigeration trains may comprise a pre-cooling heat exchanger, a main cryogenic heat exchanger, a warm-mixed refrigeration circuit, a cold-mixed refrigeration circuit, an expander, and an end flash vessel. In some aspects, a substantial portion of the first refrigeration train may be aft of a mid-ship axis of the apparatus, a substantial portion of the second refrigeration train may be forward of the mid-ship axis, and a weight of the first refrigeration train may be balanced against a weight of the second refrigeration train about the mid-ship axis to stabilize the water-based apparatus. According to these aspects, the water-based apparatus may not comprise a primary power generation system or a gas preprocessing system.

Yet another aspect is a method of at-shore liquefaction. This method may comprise: inputting to a water-based apparatus, electricity and preprocessed feed gas from a source; converting the preprocessed feed gas into a liquefied natural gas ("LNG") with an air-cooled electric refrigeration module ("AER Module") of the water-based apparatus; outputting the LNG from the AER Module to a plurality of LNG storage tanks of the water-based apparatus; and outputting the LNG from the plurality of LNG storage tanks to an LNG transport vessel.

In some aspect, the method may comprise generating the preprocessed feed gas by removing at least heavy hydrocarbons at the source and/or routing the LNG through the upper deck when outputting the LNG from the AER Module and the plurality of LNG storage tanks. For example, the method may comprise routing the LNG through an output port at or adjacent a midship axis of the apparatus when outputting the LNG from the plurality of LNG storage tanks to the LNG transport vessel. The method may comprise collecting a first gas from the AER Module and a second gas from the plurality of LNG storage tanks, and outputting the first gas and the second gas to at least one compressor. The method also may comprise inputting a third gas from the LNG transport vessel and outputting the third gas to the at least one compressor.

For safety, the method may comprise detecting cryogenic spills and releases of flammable gas with a plurality of sensors of the water-based apparatus. And for stability, the method may comprise moving a ballast fluid within a closed loop ballast system of the water-based apparatus to stabilize the apparatus without discharging any of the ballast fluid. In some aspects, converting the preprocessed feed gas into the LNG may comprise performing a dual-mixed refrigeration process with the AER Module. The method may comprise generating at least a portion of the electricity with a power generator at the source. In some aspects, the method also may comprise operating and controlling the water-based apparatus and the source with a controller in communication with both the source and the water-based apparatus.

Still another aspect is a method of manufacturing a water-based apparatus for at-shore liquefaction. This method may comprise: receiving a hull assembled at a first location; assembling an air-cooled electric refrigeration module ("AER Module") at a second location different from the first location; attaching the AER Module to the hull at the second location; testing systems of the AER Module and the hull at the second location; and moving the hull to an at-shore location different from the first location and the second location.

The received hull may include a plurality of LNG storage tanks assembled in the hull at the first location. In some aspects, the method may comprise locating a ballast fluid in a void space above the plurality of LNG storage tanks to obtain a hull deflection at the second location. For example, the method may comprise further maintaining the hull deflection by incrementally releasing the ballast fluid while attaching the AER Module at the second location so that a weight applied by the ballast fluid is reduced in proportion to a weight applied by the AER Module.

Still yet another aspect is a method of using a water-based apparatus for at-shore liquefaction. This method may comprise: moving the water-based apparatus to an at-shore location comprising a source of electricity and preprocessed feed gas; inputting the electricity and the preprocessed feed gas from the source to an air-cooled refrigeration module ("AER Module") of the water-based apparatus; and outputting a liquefied natural gas ("LNG") from the AER Module to a plurality of LNG storage tanks of the water-based apparatus.

This method may comprise outputting fuel gas from the water-based apparatus to the source and generating at least a portion of the electricity with the fuel gas. Some aspects may comprise outputting the LNG from the plurality of LNG storage tanks to an LNG transport vessel and/or inputting additional fuel gas from the LNG transport vessel.

Related kits are also disclosed. Other aspects and features of the present disclosure will become apparent to those ordinarily skilled in the art upon review of the following description of illustrative embodiments in conjunction with the accompanying figures.

BRIEF DESCRIPTION OF THE DRAWINGS

The accompanying drawings constitute part of the present disclosure. Each drawing illustrates exemplary aspects of this disclosure that, together with the written descriptions, serve to explain the principles described herein.

DETAILED DESCRIPTION

Aspects of the present disclosure are now described with reference to exemplary liquefaction apparatus, methods, and systems. Some aspects are described with reference to a water-based apparatus comprising a refrigeration module and a plurality of LNG storage tanks. The refrigeration module may be described as air-cooled, electrically driven, and located on the water-based apparatus; and each LNG storage tank may be described as a membrane tank located in a hull of the apparatus. Unless claimed, these exemplary descriptions are provided for convenience and not intended to limit the present disclosure. Accordingly, the described aspects may be applicable to any liquefaction apparatus, methods, or systems.

Figure 2:
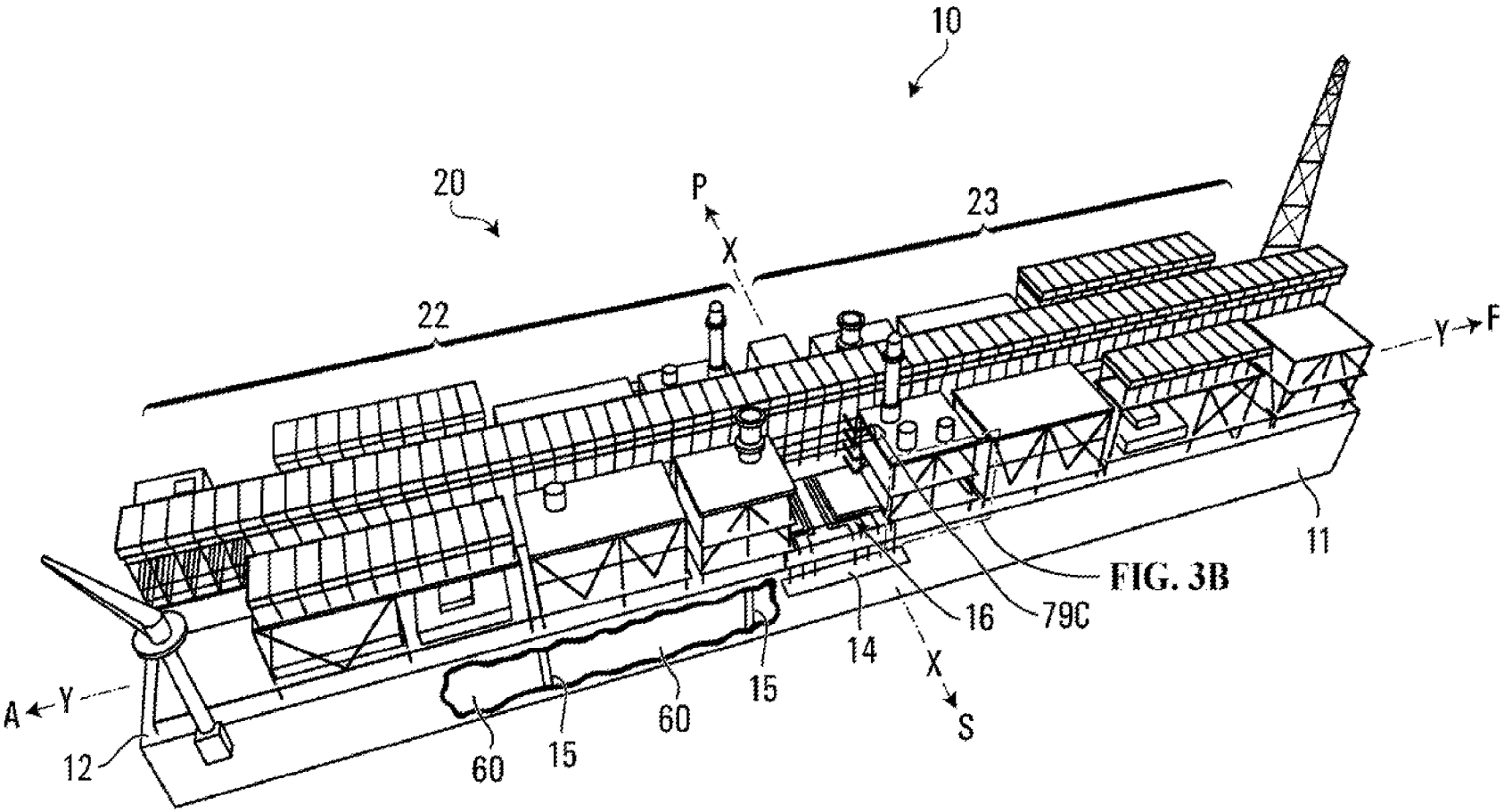
FIG. 2 depicts an exemplary water-based apparatus.

Nautical terms are used in this disclosure. For example, nautical terms such as "aft," "forward," "starboard," and "port" may be used to describe relative directions and orientations; and their respective initials "A," "F," "S," and "P," may be appended to an arrow to depict a direction or orientation. In this disclosure, forward means toward a front (or "bow") of the apparatus; aft means toward a rear (or "stern") of the apparatus; port means toward a left side of the apparatus; and starboard means toward a right side of the apparatus. As shown in FIGS. 2-4, these terms may be used in relation to one or more axes, such a mid-ship axis X-X extending from starboard to port at a middle of the apparatus, and a centerline axis Y-Y extending from bow to stern along a length of the apparatus. Other nautical terms also may be used, such as: "bulkhead," meaning a vertical structure or wall within the hull of the apparatus; "deck," meaning a horizontal structure or floor in the apparatus; and "hull," meaning the shell and framework of the floatation-oriented part of the apparatus.

Unless claimed, these nautical terms and axes are provided for convenience and ease of description, and not intended to limit aspects of the present disclosure to a particular direction or orientation. Any other terms of art used herein are similarly non-limiting unless claimed. As used herein, terms such as "comprises," "comprising," or any variation thereof, are intended to cover a non-exclusive inclusion, such that an aspect of a method or apparatus that comprises a list of elements does not include only those elements; but may include other elements that are not expressly listed and/or inherent to such aspect. In addition, the term "exemplary" is used in the sense of "example," rather than "ideal."

Figure 1:
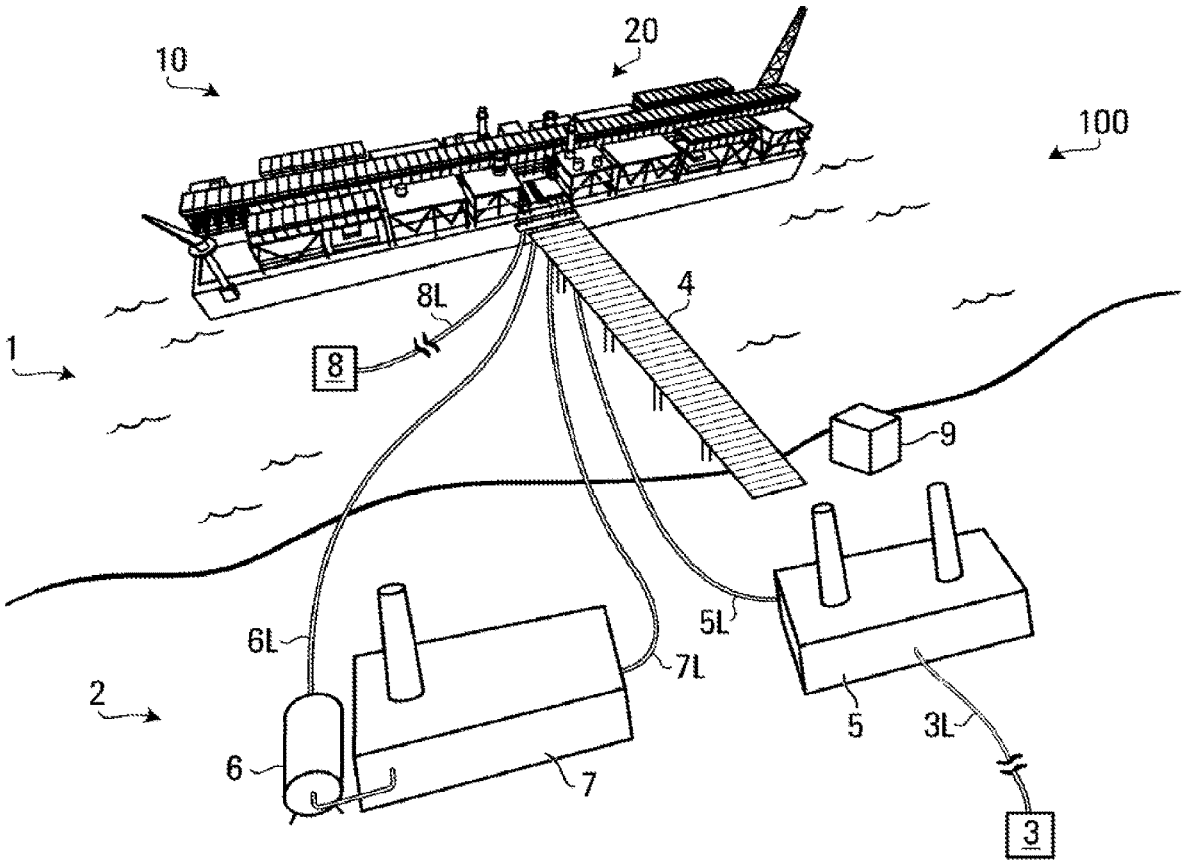
FIG. 1 depicts an exemplary liquefaction system.

An exemplary water-based apparatus 10 for at-shore liquefaction is shown in FIG. 1 as being positioned at-shore in shallow waters 1 to input preprocessed natural gas (or "preprocessed feed gas") and output liquefied natural gas (or "LNG") with minimal environmental impact on shallow waters 1. Water-based apparatus 10 may perform any number of liquefaction methods or processes at-shore. For example, apparatus 10 may comprise: an air-cooled electric refrigeration module 20 (an "AER Module") that inputs the electricity and the preprocessed feed gas from a source 2, converts the preprocessed feed gas into LNG by liquefaction, and outputs the LNG for storage or transport. The AER Module may comprise one or more refrigeration trains utilizing any combination of electric compressors, air coolers, and/or knock-out drums configured to liquefy the preprocessed feed gas without discharging substantial amounts of contaminants or energy to shallow waters 1. To further reduce environmental impacts, apparatus 10 may: be stabilized without discharging ballast fluid to the shallow waters 1; input excess boil-off gas from other vessels; and include a flat-bottom hull to minimize contact with natural structures when traversing waters 1.

Aspects of water-based apparatus 10 may be utilized within a system 100 for at-shore liquefaction. As shown in FIGS. 1-4, system 100 may comprise: a source 2 of electricity and preprocessed feed gas; and water-based apparatus 10. To accommodate at-shore use of system 100 in shallow waters 1, water-based apparatus 10 may comprise: (i) an AER Module 20 configured to input the electricity and the preprocessed feed gas from source 2, convert the preprocessed feed gas into the LNG, and output the LNG; and (ii) a plurality of LNG storage tanks 60 configured to input the LNG from the AER Module 20 and output the LNG to an LNG carrier or transport vessel 8. Numerous examples of Module 20 and tanks 60 are described.

Source 2 may include a single or combined source of the electricity and the preprocessed feed gas. As shown in FIG. 1, for example, source 2 may comprise one or more land-based facilities including a preprocessing plant 5, a fuel gas mixing vessel 6, a power plant 7, and a control room 9. One of a port side or a starboard side of water-based apparatus 10 may be moored to an at-shore anchor 4 (e.g., a jetty or quayside) to fix the position of apparatus 10 relative to source 2. In FIG. 1, for example, the starboard side of apparatus 10 is moored to an at-shore anchor 4 and engaged with the walkway structure (e.g., a portion of anchor 4) that provides walk-on access to apparatus 10 from source 2 or adjacent land.

As also shown in FIG. 1, preprocessing plant 5 may: (i) input unprocessed natural gas from a natural gas source 3 via a line 3L; (ii) generate the preprocessed feed gas by removing unwanted elements from the unprocessed natural gas; and (iii) output the preprocessed feed gas to water-based apparatus 10 via a line 5L extending between preprocessing plant 5 and apparatus 10. Natural gas source 3 is shown conceptually in FIG. 1 as comprising any natural or man-made source(s) of natural gas, including any natural gas field(s) located under shallow water 1 and/or land proximate to source 2. Preprocessing plant 5 may use any known methods or processes to remove the unwanted elements, such as heavy hydrocarbons; and compress the preprocessed gas for delivery to water-based apparatus 10 via line 5L. An exemplary specification of the preprocessed feed gas output from plant 5 is provided below:

| Parameter | Units | Target Specification |
|---|---|---|
| Carbon Dioxide | ppmv | <50 |
| Hydrogen Sulphide | grains per 100 scf | <0.25 |
| Total Sulphur | grains per 100 scf | <1.30 |
| Benzene | ppmv | <1 |
| n-Hexane | ppmv | <300 |
| n-Heptane | ppmv | <20 |
| n-Octane | ppmv | <1 |
| n-Nonane | ppmv | <1 |
| n-Decane | ppmv | <1 |
| Water | ppmv | <1 |
| Mercury | $Ng/Nm^3$ | <10 |

Power plant 7 may output the electricity to water-based apparatus via a line 7L that may include a plurality of electrical conductors. For example, the electricity may be equal or greater than approximately 100 kV and approximately 220 MW, the plurality of conductors may be configured to transmit the electricity. Line 7L may be supported with a cable transit bridge extending between water-based apparatus 10 and power plant 7. For example, the cable transit bridge may be attached to at-shore anchor 4, such as underneath the walkway structure shown in FIG. 1. All or a portion electricity may be obtained from an electrical grid.

Alternatively, power plant 7 may generate all or a portion of the electricity using a generator. For example, water-based apparatus 10 may output various types of fuel gas (e.g., such as boil-off gas) to fuel gas mixing vessel 6 via a line 6L; and power plant 7 may comprise a gas-powered generator that inputs the fuel gas from vessel 6 and outputs the electricity to apparatus 10 via line 7L. System 100 may be a closed-loop system. For example, power plant 7 may use the gas-powered generator to generate all or substantially all of the electricity required by water-based apparatus 10 with the fuel gas from vessel 6. To ensure continuous operation without sacrificing environmental performance, system 100 also may include additional sources of clean energy, such as batteries, solar panels, wave turbines, wind turbines, and the like.

As shown in FIG. 1, water-based apparatus 10 may output the LNG to LNG transport vessel 8 via a line 8L, allowing for continuous operation of apparatus 10. According to this disclosure, water-based apparatus 10 may be operable in shallow waters 1, whereas LNG transport vessel 8 may be an ocean-going vessel that is not be operable in shallow waters 1, such as an LNG transport carrier. Accordingly, LNG transport vessel 8 may be remote from water-based apparatus 10, line 8L may extend between vessel 8 and apparatus 10, and apparatus 10 may pump the LNG to vessel 8 though line 8L. In complement, line 8L also may input fuel gas from LNG transport vessel 8. For example, line 8L may include an output conduit for outputting the LNG to transport vessel 8 from apparatus 10, and an input conduit for inputting fuel gas (e.g., boil off gas) from vessel 8 to apparatus 10, allowing for simultaneous input and output.

Figure 5:
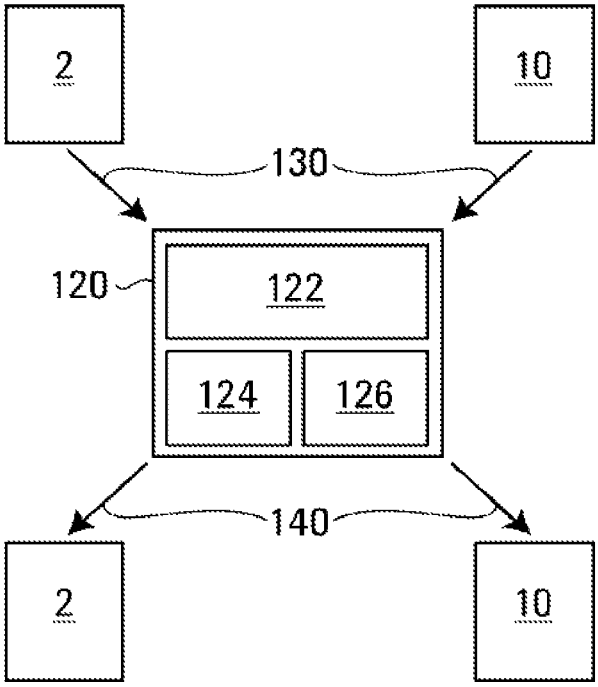
FIG. 5 depicts an exemplary controller.

Control room 9 is shown conceptually in FIG. 1 as being at source 2. Room 9 may include any technologies for monitoring and controlling system 100. As shown in FIG. 5, for example, control room 9 may comprise a controller 120 operable with source 2 and water-based apparatus 10. Controller 120 may control any operable element of apparatus 10 and/or source 2 based on data 130 input from any sensory feedback device within system 100, including any such devices on or in communication with water-based apparatus 10 and/or source 2. For example, controller 120 of FIG. 5 comprises a processing unit 122, a memory 124, and a transceiver 126 configured to: (i) input data 130 from any feedback sensory device within system 100, including any dedicated sensors, operational devices with feedback outputs, and similar devices on or in communication with apparatus 10 and/or source 2; (ii) input or generate control signals 140 based on the data 130; and (iii) output the control signals 140 to any operable elements within system 100, including any electrical and/or mechanical elements on or in communication with apparatus 10 and/or source 2, such as any actuators, compressors, motors, pumps, and similarly operable elements.

To perform these and related functions, processing unit 122 and memory 124 may comprise any combination of local and/or remote processor(s) and/or memory device(s). Any combination of wired and/or wireless communications may be used to communicate input data 130 and control signals 140 within system 100. Therefore, transceiver 126 may comprise any wired and/or wireless data communication technologies (e.g., BlueTooth®, mesh networks, optical networks, WiFi, etc.). Transceiver 126 also may be configured to establish and maintain communications within system 100 using related technologies. Accordingly, all or portions of controller 120 may be located anywhere, such as in control room 9 (e.g., a computer) and/or in any network accessible device in communication with room 9 (e.g., a smartphone in communication with the computer).

Because of the capabilities described herein, controller 120 may perform any number of coordinated functions within at-shore liquefaction system 100. One example is energy management. For example, controller 120 of FIG. 5 may perform demand response functions by: (i) analyzing data 130 regarding an electrical demand of water-based apparatus 10 (e.g., from AER Module 20) and an electrical supply of land-based source 2 (e.g., from power plant 5); and (ii) outputting control signals 140 to operable elements of AER Module 20 and/or source 2 based on the analysis to modify aspects of the electrical demand or the electrical supply according to an energy demand program. Another example is spill and leak detection. Continuing the previous example, controller 120 of FIG. 5 also may perform spill and leak detection functions by: (i) analyzing data 130 output from sensors positioned on or about apparatus 10 and/or source 2 to identify spills and leaks; and (ii) outputting control signals 140 to operable elements of AER Module 20 and/or source 2 based on the analysis to contain the spills and leaks according to a containment program.

Figure 1A:
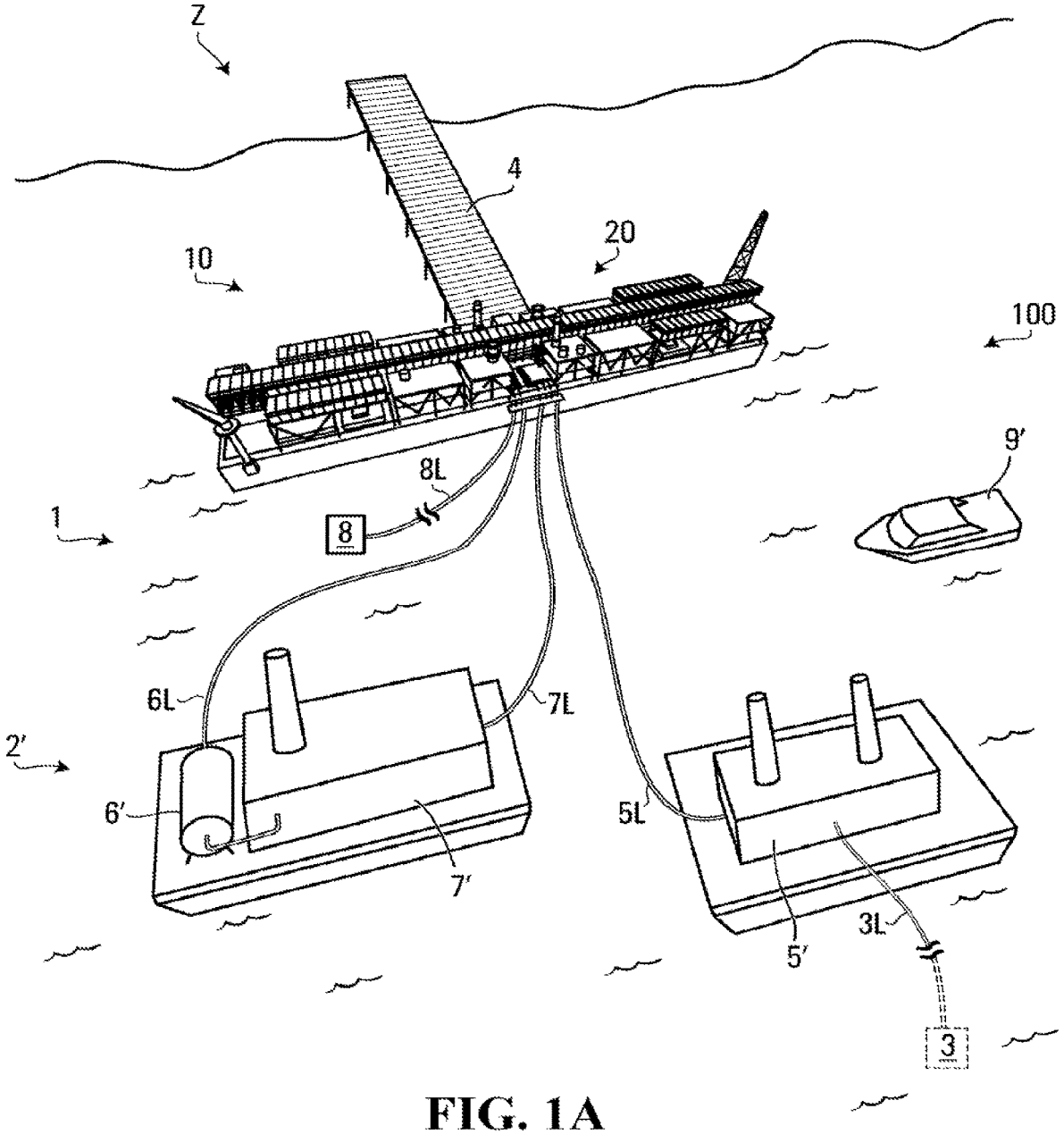
FIG. 1A depicts another exemplary liquefaction system.

As shown in FIG. 1A, system 100 may alternatively comprise a source 2' of preprocessed feed gas and electricity including one or more water-based facilities, such as a preprocessing plant 5', a fuel gas mixing vessel 6', and a power plant 7'. Each water-based facility 5', 6', and 7' of FIG. 1A may perform the same function as each corresponding land-based facility 5, 6, and 7 of FIG. 1, but on a floating platform or barge operable in shallow waters 1 or in deeper waters. In subsequent descriptions, each reference to an element of source 2 may be interchangeable with an element of source 2', regardless of the prime, meaning that some aspects may be interchangeably described with reference to 5 or 5', 6 or 6', or 7 or 7'. Some aspects of system 100 may be modified to accommodate the water-based aspects of source 2'. For example, natural gas source 3' of FIG. 1A may be located under shallow waters 1 and preprocessing plant 5' may extract raw feed gas from source 3' using any known method. As shown in FIG. 1A, one of a port side or a starboard side of water-based apparatus 10 may be moored to an at-shore anchor 4 (e.g., a jetty or quayside) to fix the position of apparatus 10 relative to a shoreline Z. In FIG. 1, for example, the starboard side of apparatus 10 is coupled to preprocessing plant 5', mixing vessel 6', power plant 7', and LNG transport vessel 8 via the same lines 5L, 6L, 7L, and 8L; and the port side of apparatus 10 is moored to at-shore anchor 4, and engaged with a walkway structure (e.g., of anchor 4) that provides walk-on access to apparatus 10 from shoreline Z.

System 100 may comprise a mobile unit 9' shown in FIG. 1A as a personal ferry. Mobile unit 9' may be independently movable relative to water-based apparatus 10, preprocessing plant 5', mixing vessel 6', and power plant 7'. For example, unit 9' may be operable within system 100 to shuttle people, equipment, and/or data between plant 5', vessel 6', plant 7', vessel 8', apparatus 10, and/or shoreline Z. As described above, portions of controller 120 and sensors in communication therewith may be located anywhere within system 100, including on plant 5', vessel 6', plant 7', vessel 8', ferry 9', and apparatus 10.

Water-based apparatus 10 may be greatly simplified within system 100 to reduce manufacturing costs. For example, apparatus 10 may rely upon source 2 to provide all of the preprocessed gas and the electricity, meaning that apparatus 10 may not comprise any of: a power generation system, a process heating system, and/or a diesel system. Because the at-shore location and shallow waters 1 may provide access to personal and supplies, apparatus 10 may be fully operational without many systems typically found on ocean-going vessels. These omissions may reduce the cost of manufacturing. For example, because of the walkway structure provided by at-shore anchor 4, apparatus 10 may not comprise any one or more of following elements: a marine loading arm; living quarters for a substantial portion of the crew; or a helideck. Likewise, because apparatus 10 may be towed to shallow waters 1 and moored to at-shore anchor 4 for extended periods (e.g., years), it also may not comprise a primary propulsion system suitable for ocean travel. As a further example, because of preprocessing plant 5 (or 5') and power plant 7 (or 7'), apparatus 10 also may not comprise a substantial gas preprocessing system, allowing for omission of any process heating and related elements otherwise provided by plant 5; or a primary power generation system, allowing for omission of any non-emergency power generators otherwise provided by plant 7.

Additional aspects of water-based apparatus 10 are now described with reference to FIGS. 1-4, in which an exemplary apparatus 10 comprises: (i) AER Module 20 on a upper deck 12 of apparatus 10 and configured to input the electricity and the preprocessed feed gas from source 2, convert the preprocessed feed gas into the LNG, and output the LNG; and (ii) plurality of LNG storage tanks 60 in a hull 11 of apparatus 10 and configured to input the LNG from AER Module 20 and output the LNG to an LNG transport vessel 8.

AER Module 20 may comprise any refrigeration technology, including any technologies utilizing air-coolers and electronically driven (or "e-Drive") compressors to precool, liquefy, and sub-cool a portion of the preprocessed feed gas. For example, AER Module 20 may comprise one or more refrigeration trains utilizing dual-mixed refrigerants, including a first refrigeration train 22 and a second refrigeration train 23. More particular aspects of apparatus 10 are now described with reference to refrigeration trains 22 and 23. These aspects are exemplary unless claimed, meaning that AER Module 20 may still comprise any number of refrigeration trains utilizing any refrigeration technology.

Each refrigeration train may utilize dual-mixed refrigerants. As shown in FIG. 4, first refrigeration train 22 may comprise a pre-cooling heat exchanger 24, a main cryogenic heat exchanger 26, a warm-mixed refrigeration circuit 28, a cold-mixed refrigeration circuit 30, an expander 32, and an end flash gas (or "EFG") vessel 34; and second refrigeration train 23 may comprise a pre-cooling heat exchanger 25, a main cryogenic heat exchanger 27, a warm-mixed refrigeration circuit 29, a cold-mixed refrigeration circuit 31, an expander 33, and an EFG vessel 35. Pre-cooling heat exchanger 24 and 25 may include shell and tube heat exchangers that input the preprocessed feed gas, cool it against warm-mixed refrigeration circuits 28 and 29, and output a first cooled gas. Main cryogenic heat exchangers 26 and 27 may include shell and tube heat exchangers that input the first cooled gas, cool it against cold-mixed refrigeration circuits 30 and 31, and output a second cooled gas. Expanders 32, 33 and EFG vessels 34, 35 may input the second cooled gas, and output the LNG and fuel gas.

Each refrigeration train may operate independently. For example, first refrigeration train 22 may receive a first portion of the preprocessed feed gas and output a first portion of the LNG; and second refrigeration train 23 may receive a second portion of the feed gas and output a second portion of the LNG. Each refrigeration train may be all-electric. For example, warm-mixed refrigeration circuits 28 and 29 of FIG. 4 may include electric compressors to perform a first closed-loop refrigeration cycle including two-stage compression; and cold-mixed refrigeration circuits 30 and 31 of FIG. 4 may include electric compressors to perform a closed-loop refrigeration cycle including three-stage compression. Each refrigeration train also may be air-cooled. For example, each first refrigeration cycle may be performed by a first set of air coolers and knock-out drums 42 or 44, and each second refrigeration cycle may be performed by a second set of air coolers and knock-out drums 43 or 45.

Various benefits may be realized with particular arrangements of one or more refrigeration trains. For example, first and second refrigeration trains 22, 23 of FIG. 4 are arranged on each side of a central portion 16 of upper deck 12 to further stabilize water-based apparatus 10 and minimize sloshing in LNG storage tanks 60. As shown in FIG. 4, central portion 16 may be one or adjacent mid-ship axis X-X of apparatus 10, a substantial portion (e.g., more than 50%) of first refrigeration train 22 may be aft of the mid-ship axis, and a substantial portion (e.g., more than 50%) of second refrigeration train 23 may be forward of mid-ship axis X-X. Accordingly, a weight of refrigeration train 22 may be balanced against a weight of refrigeration train 23 about mid-ship axis X-X, further stabilizing water-based apparatus 10 at central portion 16, where at-shore anchor 4 may be attached, as in FIG. 1.

Figure 3A:
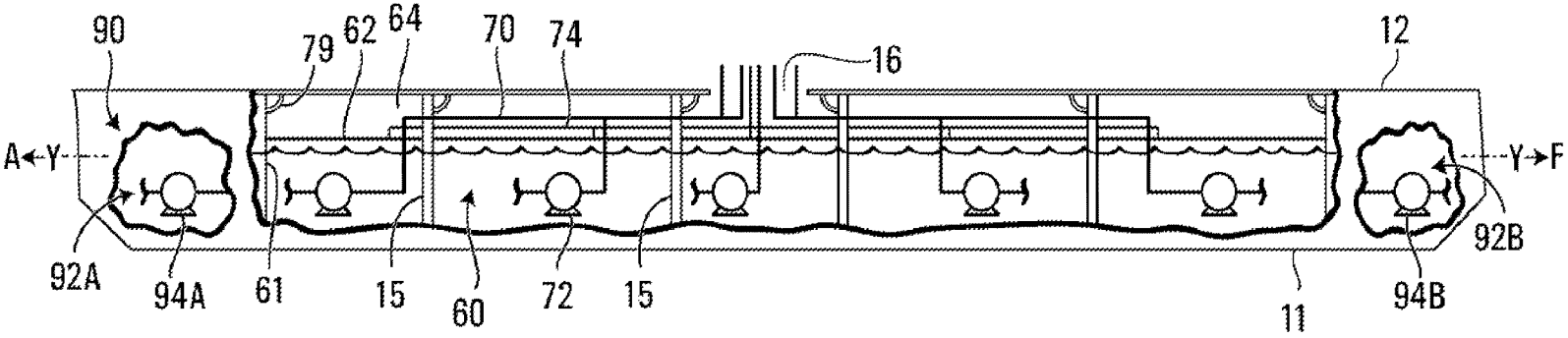
FIG. 3A depicts an exemplary hull of the FIG. 2 apparatus.
Figure 3B:
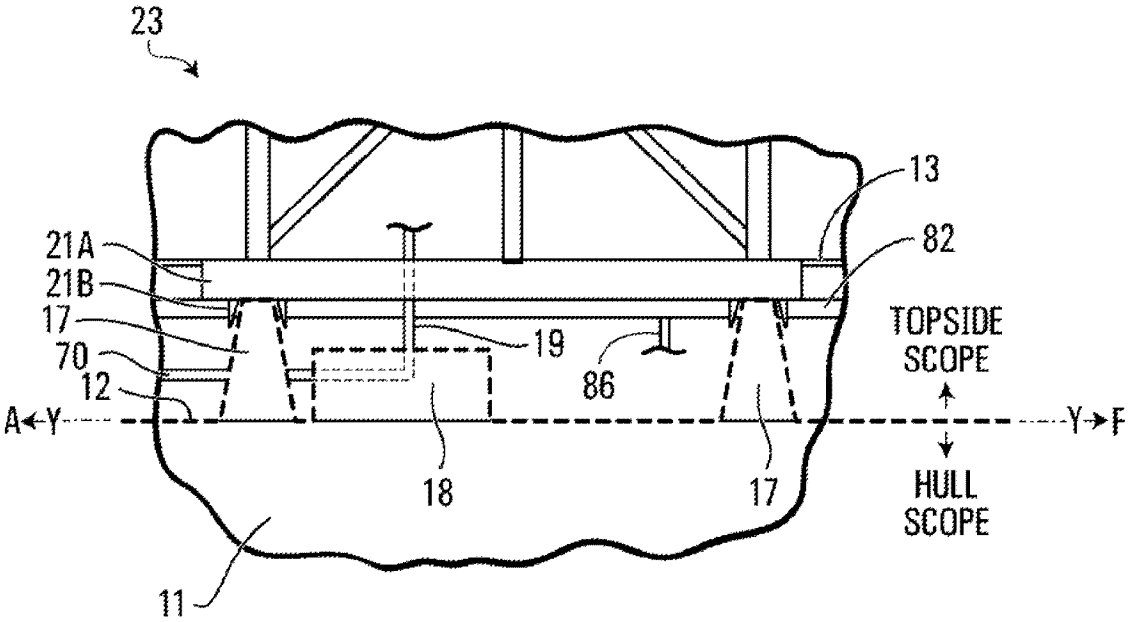
FIG. 3B depicts an exemplary cut-a-way view of the hull of FIG. 3A.
Figure 4:
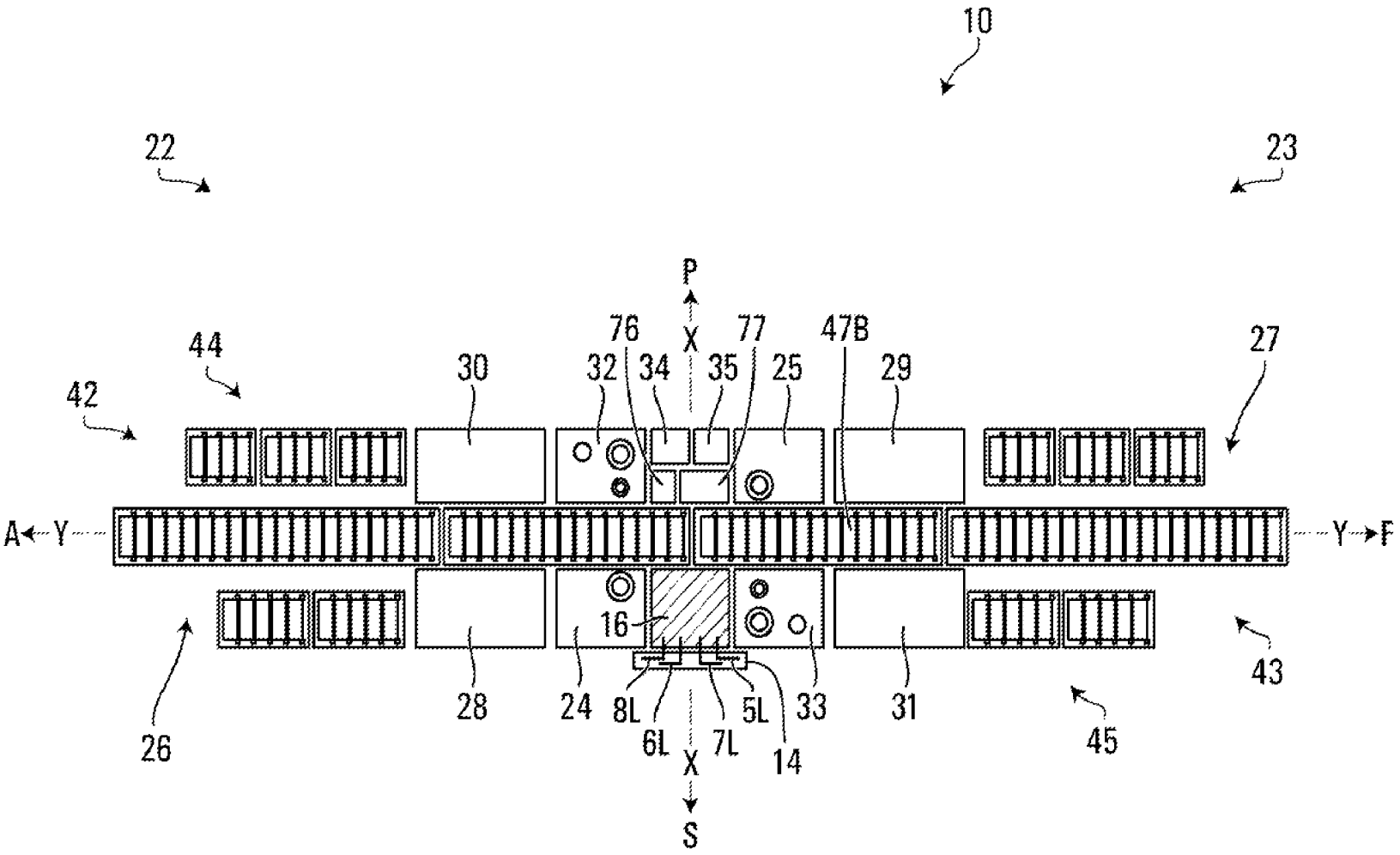
FIG. 4 depicts an exemplary refrigeration module.

As shown in FIGS. 3A and 3B, hull 11 may be a double-hull design with an inner hull and an outer hull. Main or upper deck 12 may be attached to hull 11. For example, deck 12 of FIG. 3A may comprise metal plates spanning between the port and starboard sides apparatus 10 to seal hull 11 off from deck 12. As shown in FIG. 3B, AER Module 20 may be supported on a process deck 13 of upper deck 12, and a plurality of support structures 17 may extend through upper deck 12 to support process deck 13. Each support structure 17 may extend from a point of attachment to hull 11 (e.g., from a support beam attached thereto) and through an opening in upper deck 12 for engagement with an element of AER Module 20. For example, each element of AER Module 20 may include a support frame 21A with a plurality of seats 21B, and each seat 21B may be engageable with one of support structures 17 to support a weight of the element of Module 20 and restrain relative movements. As shown in FIG. 3B, for example, an element of second refrigeration train 23 may be attached to one of frames 21A by a corresponding seat 21B with a connection that limits the transfer of vibrations from AER Module 20 to upper deck 12 during operation of apparatus 10.

Aspects of the connection between AER Module 20 and structures 17 may allow Module 20 to be manufactured separately from hull 11. For example, hull 11 may be manufactured a first location, such as a ship yard; and AER Module 20 may be manufactured at a second location different from the first location, such as a dedicated manufacturing facility at, adjacent, or accessible to the ship yard. As a further example, AER Module 20 may be attached to hull 11 at either the first or second location depending upon the expense and logistics of transporting hull 11 to AER Module 20 or vice versa. As shown by the dotted line in FIG. 3B, separate manufacturing may be supported by defining a hull scope of work to be performed at the first location (e.g., with a first set of contractors); and a topside scope of work to be performed at the second location (e.g., with a second set of contractors).

The topside scope and the hull scope may be defined relative to upper deck 12. For example, the topside scope may include aspects related to AER Module 20; and the hull scope may include aspects related to plurality of LNG storage tanks 60. As a further example, the hull scope may include attaching structures 17 to hull 11 at the first location; and the topside scope may include attaching AER Module 20 to structures 17 with frames 21A and seats 21B at the first or second location. Related methods are described further below. As also shown in FIG. 3B, the hull scope may comprise attaching a junction 18 under each elements of AER Module 20, and routing various supply and distributions systems to-and-from each junction 18 for immediate hook-up to Module 20 once attached to structures 17 using connective piping 19. In FIG. 3, for example, piping from an LNG distribution system 70 described further below has been routed from LNG storage tanks 60 to junction 18 as part of the hull scope to simplify attachment of Module 20. Connective piping 19 also may be configured to limit the transfer of vibrations from AER Module 20.

The plurality of LNG storage tanks 60 may be located in hull 11. For example, the inner hull may include a plurality of bulkheads 15, and the tanks 60 may be located between the bulkheads 15. As shown in FIG. 3A, tanks 60 may comprise a single row of tanks spaced apart along a centerline axis Y-Y of apparatus 10. A storage volume of each tank 60 may be approximately centered on the centerline axis Y-Y to reduce unbalanced loading. Each tank 60 may be a membrane type tank. For example, each tank 60 may include an irregular cross-sectional shape that is defined by the inner hull of hull 11 and centered on axis Y-Y. As shown in FIG. 3A, each tank 60 may include a lower membrane 61 that defines a storage volume between the bulkheads 15 and the inner hull of hull 11; and an upper membrane 62 that seals the storage volume. Membranes 61 and 62 may be joined by any means.

As shown in FIG. 3A, top surfaces of upper membranes 62 may be spaced apart from upper deck 12 to define a void space 64. Bulkheads 15 may include openings in communication with void space 64, allowing pipes and wiring to be routed under deck 12. Various elements may be routed through void space 64. For example, pipes and wiring may be routed through space 64 and membranes 62 for access to the LNG. Void space 64 may be flooded during manufacturing of apparatus 10 to contain an amount of weight fluid (e.g., water) simulating an installed weight of AER Module 20 on upper deck 12 of hull 11. For example: exterior edges of upper membranes 62 may be sealed against one another and interior surfaces of the inner hull of hull 11 by expansion; the seal may be reinforced with adhesives on the exterior edges and/or sealants on top surfaces; and/or additional sealant layers may be applied to form an irregularly shaped volume of space 64 that contains the fluid.

As shown in FIGS. 1 and 4, an IO port 14 may be located in central portion 16 and/or on a mid-ship axis X-X of water-based apparatus 10, on the starboard side of apparatus 10 in the depicted examples. Various inputs and outputs may flow through IO port 14. In keeping with above examples, IO port 14 may comprise: a preprocessed feed gas input port engageable with line 5L; a fuel gas output port engageable with line 6L; an electricity input port engageable with line 7L; an LNG output port engageable with an output conduit of line 8L; and a fuel gas input port engageable with an input conduit of line 8L. IO port 14 may include one or more loading arms operable to control lines 5L, 6L, 7L, and/or 8L. For example, IO port 14 may comprise a high-pressure loading arm operable to control line 5L during input of the preprocessed feed gas.

Access to hull 11 from upper deck 12 may be provided by a primary opening extending through central portion 16. For example, all other openings extending through deck 12 may be secondary openings that are either: (i) smaller, incidental openings that may be sealed by sealants; or (ii) substantially occupied by structural supports. All the processing piping for moving the LNG between upper deck 12 and hull 11 may be routed through central portion 16. For example, IO port 14 may be located adjacent to the primary opening of central portion 16, and all of the LNG may be routed through the primary opening when being input from AER Module 20 to the plurality of LNG storage tanks 60 and output from tanks 60 to IO port 14.

To reduce costs, numerous operational systems of water-based apparatus 10 also may be assembled during the hull scope, prior to installing AER Module 20 during the topside scope. Exemplary operational systems may comprise: LNG distribution system 70; a fuel gas collection and distribution system 74; a sensor system 78; a containment system 80; and a closed loop ballast system 90. As described below, various aspects of systems 70, 74, 78, 80, and 90 may interface with AER Module 20 and/or be operated by controller 120.

LNG distribution system 70 may input the LNG into plurality of LNG storage tanks 60 and output the LNG from tanks 60 to IO port 14. As shown in FIG. 3A, distribution system 70 may comprise: input piping extending between AER Module 20 and tanks 60; and output piping extending between tanks 60 and IO port 14. Portions of the input and output piping for system 70 may be routed through void space 64 during the hull scope of work. For example, as part of the hull scope, the output piping for system 70 may be routed through void space 64 and connected to IO port 14; and the input piping for system 70 may be routed to through void space 64 to central portion 16 and/or one of junctions 18 and prepared for connection to AER Module 20 at a later date (e.g., capped off). As also shown in FIG. 3A, LNG distribution system 70 may further comprise at least one pump 72 located in the lower membrane 61 of each tank 60. Each pump 72 may output LNG from one of tanks 60 to IO port 14. The pumps 72 may be operated individually or together. For example, pumps 72 may output LNG from tanks 60 at about the same time to avoid unbalanced loading, such as when outputting substantially all of the LNG from tanks 60.

Fuel gas collection and distribution system 74 may input fuel gas from a plurality of sources and output the fuel gas to one of AER Module 20 or IO port 14. Different types of gas may be collected and distributed with system 74. For example, system 74 may input low-pressure fuel gas from: (i) AER Module 20 as a byproduct of liquefaction; (ii) plurality of LNG storage tanks 60 as boil-off gas; and/or (iii) LNG transport vessel 8 as excess boil-off gas. As shown in FIG. 4, fuel gas system 74 may comprise: a fuel gas compressor 76 and a recycle gas compressor 77. Fuel gas compressor 76 may convert a portion of the low-pressure fuel gas into a high-pressure fuel gas for output to line 6L. Recycle gas compressor 77 may convert a portion of low-pressure fuel gas for output back into AER Module 20. Compressors 76 and 77 may be on upper deck 12, adjacent central portion 16. Portions of the input and output piping for system 70 may be routed through void space 64 during the hull scope of work. For example, as part of the hull scope, system 74 may include piping routed through void space 64 and connected to IO port 14; and piping routed through void space 64 and prepared for connection to compressor 76, compressor 77, and AER Module 20 at a later date (e.g., capped off).

Because metal becomes brittle at low temperatures, various structural elements of water-based apparatus 10 (e.g., hull 11 and bulkheads 15) may be damaged by exposure to cryogenic spills, including any unwanted release of cryogenic liquid. Any leaks of flammable gas may pose similar risks. Sensor system 78 may determine whether spills or leaks have occurred, and containment system 80 may direct the spills overboard without damaging apparatus 10. Similar to above, a first portion of systems 78 and 80 may be assembled during the hull scope of work, and a second portion of systems 78 and 80 may be assembled during the topside scope of work.

As shown in FIG. 3A, system 78 may comprise a plurality of sensors 79 positioned about water-based apparatus 10 to detect spills or leaks, including at least sensor 79 positioned to monitor each LNG storage tank 60. Sensors 79 may include any combination of liquid and/or gas sensors, including liquid sensors utilizing fiber optic and/or ultrasonic leak detection methods, and gas sensors utilizing air-sampling methods. Some sensors 79 may detect any spills or leaks from a source of greater than a minimum orifice diameter (e.g., of approximately 2 mm). Other sensors 79 may include one or more cameras 79C positioned to detect visible effects, such as atmospheric vapor condensation and/or fog formation caused by exposing low temperature spills or leaks to the surrounding environment. As shown in FIG. 2, at least one camera 79C may be directed toward central portion 16. For example, each camera 79C may output data including a video feed to a human and/or computer operator trained to detect spills and leaks by analyzing the visible effects captured in the video feed.

Containment system 80 may cause the spills to be directed overboard without damaging apparatus 10. As shown in FIG. 3B, process deck 13 may comprise a plurality of drainage openings; and system 78 may comprise: channels 82 under the draining openings to collect cryogenic spills; and downcomers 86 in communication with channels 82 to direct the cryogenic spills over and away from one side of hull 11. Channels 82 may comprise a network of open and/or closed conduits (e.g., drip pans) arranged under process deck 13 and/or elements of AER Module 20 to reduce evaporation rates by limiting the overall vapor dispersion area. As shown in FIG. 3B, each downcomer 86 may extend outwardly from one side of hull 11; and may include nozzles operable to protect the one side of hull 11 from direct exposure to the cryogenic spill by outputting water in response to sensors 79. System 80 may likewise comprise a plurality of actuators positioned about apparatus 10 to automatically close valves, re-route gas or liquid flows, and isolate elements in response to sensors 79.

Aspects of closed loop ballast system 90 are shown in FIG. 3A. As shown, ballast system 90 may comprise: a plurality of ballast tanks 92 including a pump 94 configured to stabilize water-based apparatus 10 by moving a ballast fluid between the tanks 92 without discharging any of the ballast fluid to the environment. The ballast tanks 92 and pump 94 may be located anywhere in hull 11. In FIG. 3A, a first ballast tank 92A and pump 94A is located in an aft portion of hull 11, a second ballast tank 92B and pump 94B is located in a forward portion of hull 11, and the ballast fluid may be moved between tanks 92A and 92B with pumps 94A and 94B to stabilize water-based apparatus 10. The plurality of sensors 79 may include position sensors (e.g., gyroscopes) to identify a desired orientation of water-based apparatus 10, calculate a flow of ballast fluid required to obtain the desired orientation, and output signals causing the pumps 94 to circulate the flow of ballast fluid between the tanks 92 in a closed loop, without discharge to shallow waters 1.

Exemplary methods of operating, manufacturing, and using apparatus 10 are now described with reference to a method 200 of at-shore liquefaction (e.g., FIG. 6), a method 300 of manufacturing a water-based apparatus (e.g., FIG. 7), and a method 400 of using a water-based apparatus (e.g., FIG. 8). For ease of description, aspects of methods 200, 300, and 400 may be described with reference to water-based apparatus 10. Unless claimed, these references are exemplary and non-limiting, meaning that methods 200, 300, and 400 may be used with any configuration of water-based apparatus 10 or a similar apparatus.

Figure 6:
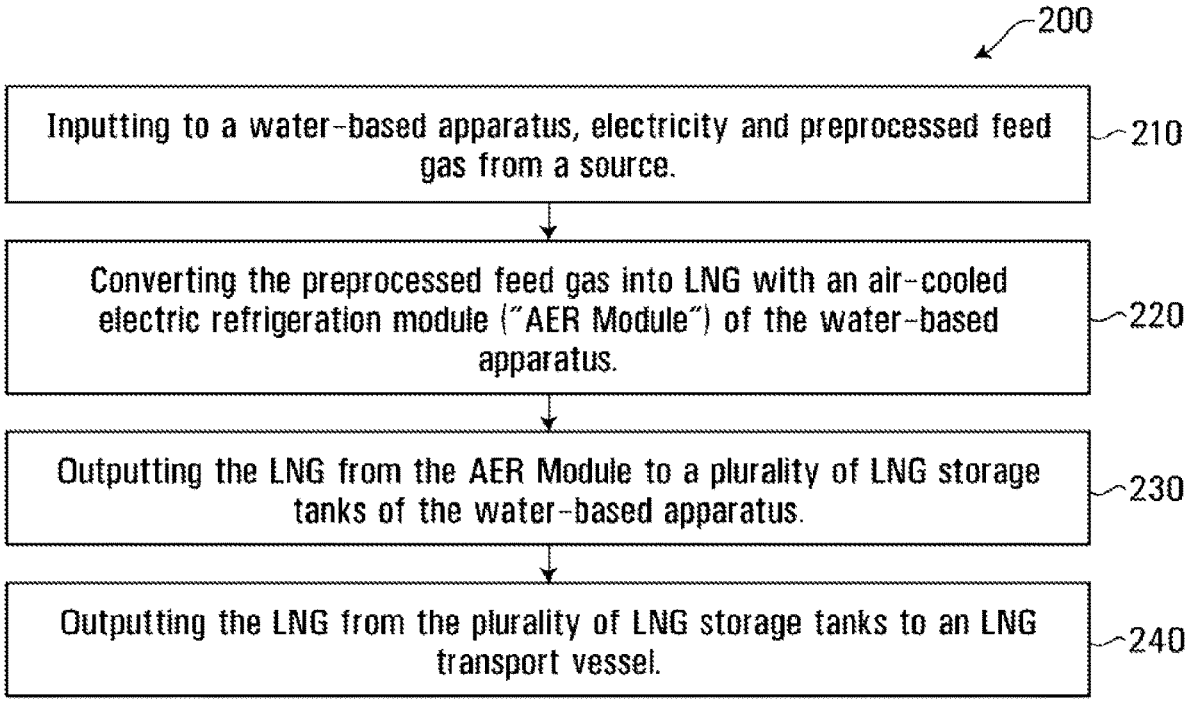
FIG. 6 depicts an exemplary liquefaction method.

As shown in FIG. 6, method 200 of at-shore liquefaction may comprise: (i) inputting to water-based apparatus 10, electricity and preprocessed feed gas from source 2 (an "inputting step 210"); (ii) converting the preprocessed feed gas into the LNG with AER Module 20 (a "converting step 220") on upper deck 12; (iii) outputting the LNG from AER Module 20 to plurality of LNG storage tanks 60 in hull 11 (a "first outputting step 230"); and (iv) outputting the LNG from tanks 60 to LNG transport vessel 8 (a "second outputting step 240").

Inputting step 210 may comprise intermediate steps for producing the preprocessed feed gas. For example, step 210 may comprise: inputting raw or unprocessed natural gas to preprocessing plant 5, performing various processes to remove unwanted elements (e.g. heavy hydrocarbons), and outputting the preprocessed feed gas from plant 5. Any known process may be used in step 210 to remove at least heavy hydrocarbons at source 2.

Converting step 220 may comprise intermediate steps based on the configuration of apparatus 10. For example, step 220 may comprise performing a dual-mixed refrigeration process with AER Module 20. In this example, converting step 220 may comprise: a pre-cooling process; a refrigeration process; an expansion process; and a storage process. The pre-cooling process may comprise cooling a portion of the preprocessed feed gas against a warm-mixed refrigeration circuit 28 or 29 and outputting a first cooled gas. The refrigeration process may comprise performing a first closed-loop refrigeration cycle including two-stage compression, performing a second closed-loop refrigeration cycle including three-stage compression, cooling the first cooled gas against a cold-mixed refrigeration circuit 30 or 31, and outputting a second cooled gas. The expansion process may comprise reducing a pressure of the second cooled gas (e.g., with expander 32) to produce chilled liquid natural gas, routing the chilled natural to an end flash gas vessel (e.g., vessel 34), and outputting the LNG and fuel gas from the vessel. And the storage process may comprise outputting the LNG from the vessel to LNG distribution system 70 and routing the LNG into tanks 60 therewith.

First outputting step 230 may comprise intermediate steps for outputting the LNG to vessel 8, such as operating the pump 72 in each LNG storage tank 60 to output the LNG to LNG transport vessel 8 through IO port 14 and line 8L. For example, step 230 may comprise routing the LNG through central portion 16 of upper deck 12 when outputting the LNG from AER Module 20 and tanks 60. Second output step 240 may likewise comprise intermediate steps for outputting the fuel gas. For example, step 240 may comprise utilizing fuel gas collection and distribution system 74 to collect low pressure fuel gas from the various sources, such as AER Module 20, the plurality of LNG storage tanks 60, and/or LNG transport vessel 8. In keeping with above, additional steps of step 240 may comprise: compressing the collected low-pressure fuel gas into a high-pressure fuel gas and outputting the high-pressure feed gas to source 2 through IO port 14 and line 6L.

Method 200 also may comprise additional steps. For example, method 200 may further comprise: detecting any spills of cryogenic fluid or releases of flammable gas with plurality of sensors 79; moving a ballast fluid within closed loop ballast system 90 to stabilize the apparatus without discharging any of the ballast fluid; generating at least a portion of the electricity with the source 2; and/or operating apparatus 10 and source 2 with controller 120 located on apparatus 10, at source 2, or on another water-based apparatus.

Figure 7:
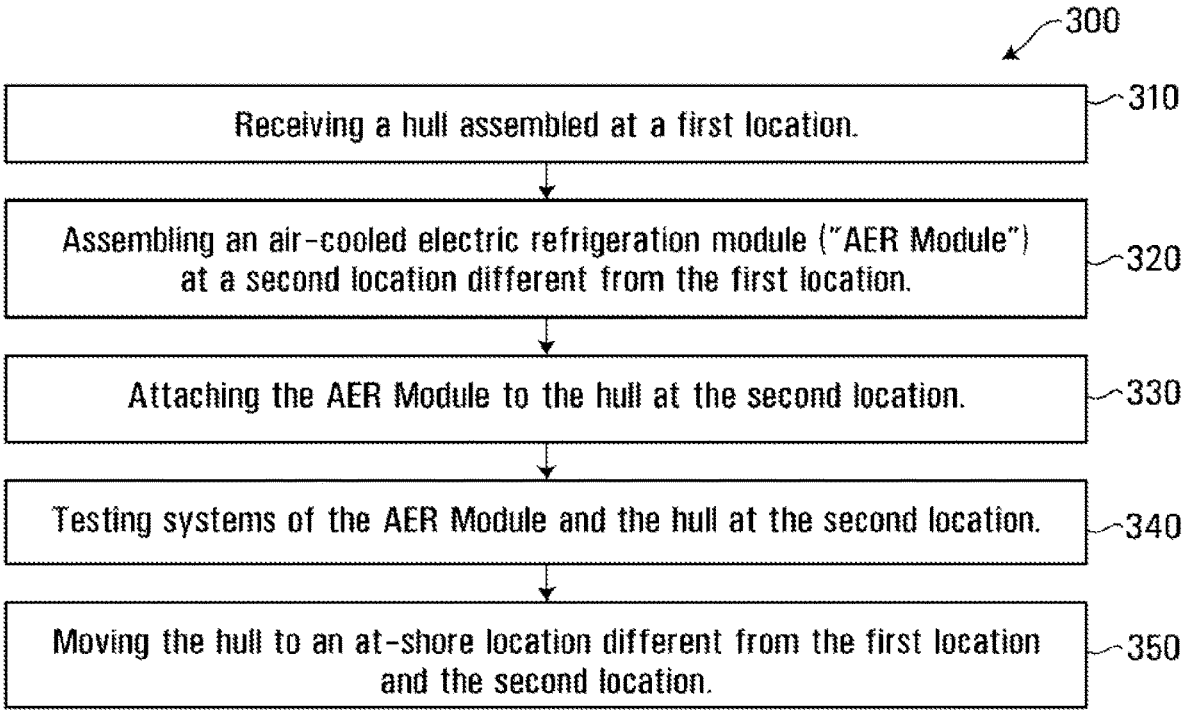
FIG. 7 depicts an exemplary manufacturing method.

As shown in FIG. 7, manufacturing method 300 may comprise: (i) receiving hull 11 at a first location (a "receiving step 310"); (ii) assembling AER Module 20 at a second location different from the first location (an "assembling step 320"); (iii) attaching AER Module 20 to upper deck 12 of hull 11 at the second location; (an "attaching step 330"); (iv) testing systems of AER Module 20 and hull 11 at the second location (a "testing step 340"); and (v) moving hull 11 and attached AER Module 20 to an at-shore location different from the first location and the second location (a "moving step 350"). As described above, the first location may comprise a ship yard; the second location may comprise a dedicated manufacturing facility at, adjacent or accessible to the ship yard; and the third location may be at-shore.

Receiving step 310 may comprise intermediate steps associated with the hull scope of work (e.g., FIG. 3B). For example, step 310 may comprise intermediate steps for assembling LNG storage tanks 60 in hull 11, attaching support structures 17, routing piping to junctions 18, and performing like steps. As a further example, step 310 also may comprise moving hull 11 from the first location to the second location, such as by towing the completed hull 11 thereto. Assembling step 320 may comprise intermediate steps associated with the topside scope of work, such as assembling AER Module 20 and preparing Module 20 for attachment to upper deck 12 of hull 11 at the second location. For example, step 310 may comprise: assembling a kit including AER Module 20 as well as related fittings (e.g., connective piping 19), tools, and instructions.

Attaching step 330 may comprise intermediate steps for attaching AER Module 20 and rendering Module 20 operational. For example, after assembling tanks 60, attaching step 330 may comprise: locating a ballast fluid in void space 64 before attaching AER Module 20 to control deflections of hull 11 by simulating a weight of AER Module 20; and incrementally releasing the ballast fluid while attaching AER Module 20 so that the simulated weight applied by the ballast fluid is reduced in proportion to an actual weight applied by AER Module 20. As a further example, once the actual weight of AER Module 20 has been applied, step 330 may further comprise attaching each seat 21B to one of the structures 17 and/or coupling connective piping 19 from AER Module 20 to the piping at each junction 18.

Testing step 340 may comprise intermediate steps for operatively coupling AER Module 20 with the plurality of tanks 60 and any support systems, including systems 70, 74, 78, and 80 described above. Each interconnection and system may be tested individually and/or together during step 340, allowing water-based apparatus 10 to be fully commission and substantially ready for use after step 340. Moving step 350 may comprise intermediate steps for moving apparatus 10 in position relative to source 2. For example, because apparatus 10 may not comprise a primary propulsion system, step 350 may comprise attaching apparatus 10 to another water-based apparatus (e.g., a tug boat) and towing apparatus 10.

Figure 8:
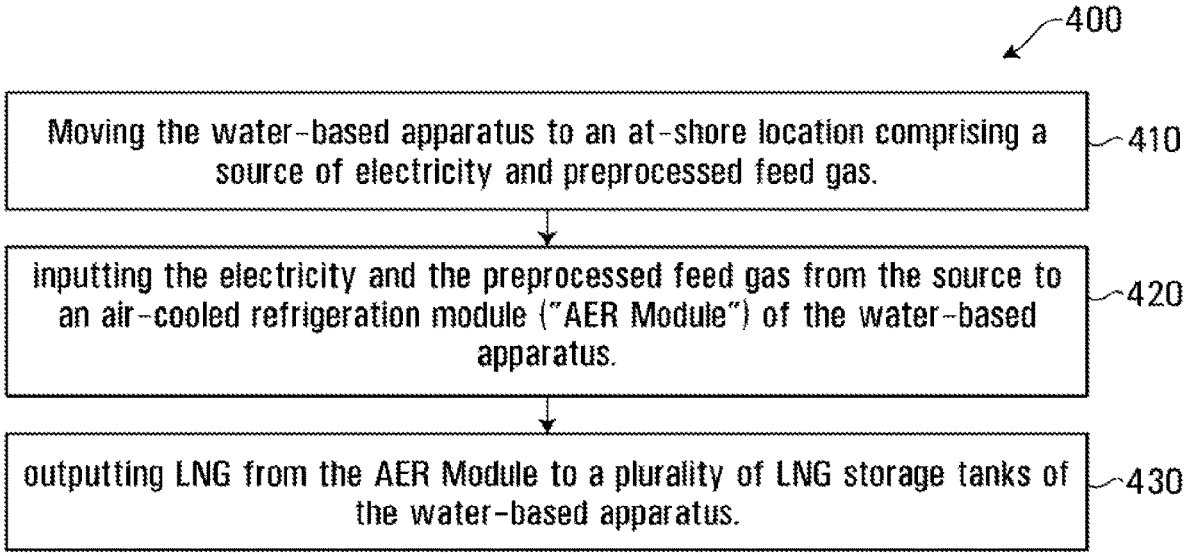
FIG. 8 depicts an exemplary method of use.

As shown in FIG. 8, method of use 400 may comprise: (i) moving water-based apparatus 10 to an at-shore location adjacent source 2 (a "moving step 410"); (ii) inputting electricity and preprocessed feed gas from AER Module 20 to source 2 (an "inputting step 420"); and (iii) outputting the LNG from AER Module 20 to plurality of LNG storage tanks 60 (an outputting step 430). Because water-based apparatus 10 is movable, method 400 may further comprise: moving apparatus 10 to a second at-shore location adjacent a second source 2 and repeating the inputting and outputting steps 420 and 430.

Moving step 410 may comprise intermediate steps for positioning the water-based apparatus relative to source 2, such as mooring apparatus 10 to at-shore anchor 4, and/or engaging one side of apparatus 10 with the walkway structure of anchor 4. Inputting step 420 may comprise intermediate steps for operatively coupling apparatus 10 and source 2, such as: coupling IO port 14 with each of lines 5L, 6L, 7L, and 8L; and establishing communications between apparatus 10, source 2, control room 9 and/or controller 120. Outputting step 430 may comprise intermediate steps for preparing tanks 60 to input the LNG, and outputting step 440 may comprise intermediate steps for preparing source 2 to input the fuel gas.

Method 400 also may comprise additional steps. For example, method 400 may further comprise: outputting fuel gas from apparatus 10 to source 2; generating at least a portion of the electricity with the fuel gas at source 2; outputting the LNG from plurality of LNG storage tanks 60 to LNG transport vessel 8; inputting additional fuel gas from LNG transport vessel 8; and/or any other methods of using apparatus 10 and system 100.

According to the improvements described herein, unprocessed natural gas from at-shore reserves may be delivered to market using water-based apparatus 10. Numerous aspects of apparatus 10 are described, including those described with reference to system 100 and methods 200, 300, and 400. Many of these aspects may be interchangeable, with each combination and/or iteration being part of this disclosure. For example, aspects of closed-loop system 100 and controller 120 may be operable with any type of apparatus 10 utilizing any type of refrigeration technology. As a further example, aspects of methods 200, 300, and 400 may likewise be performed with any variation of apparatus 10 or a similar apparatus.

While principles of the present disclosure are disclosed herein with reference to illustrative aspects of particular applications, the disclosure is not limited thereto. Those having ordinary skill in the art and access to the teachings provided herein will recognize the additional modifications, applications, aspects, and substitution of equivalents may all fall in the scope of the aspects described herein. Accordingly, the present disclosure is not to be considered as limited by the foregoing descriptions.

What is claimed is:

1. A method of manufacturing an at-shore water-based apparatus for liquefaction of natural gas, wherein the water-based apparatus comprises a hull defining a bow, a stern, and a centerline axis extending from the bow to the stern and the water-based apparatus is configured to be moored to an at-shore location, the method comprising:

determining a weight of an AER System;

locating a ballast medium in the hull, the ballast medium having a simulated weight approximate to the weight of the AER System;

determining a deflection of the hull caused by the simulated weight;

moving the ballast medium off the hull while attaching the AER System to the hull so that the weight of the ballast medium supported by the hull is reduced in proportion to the simulated weight applied to the hull in order to maintain the deflection of the hull while the AER System is attached;

assembling a plurality of LNG storage tanks in the hull, wherein the LNG storage tanks are spaced apart in a single row along the centerline axis of the hull; and coupling the AER System with the LNG storage tanks, such that the LNG storage tanks are operatively configured to receive the LNG from the AER System and operatively configured to output the LNG to an LNG transport vessel that is separate from the water-based apparatus.

2. The method of claim 1, wherein the AER System is configured to (i) receive electricity and feed gas from an external source, wherein the external source is separate from the water-based apparatus, (ii) perform a refrigeration process for converting the feed gas into LNG with the electricity from the external source using a plurality of electrically-driven compressors and a cryogenic heat exchanger operatively configured on the water-based apparatus, (iii) discharge substantially all thermal energy from the refrigeration process to ambient air with air coolers, and (iv) output the LNG.

3. The method of claim 1, wherein each of the plurality of LNG storage tanks is below an upper deck of the hull so as to create a void space between the plurality of LNG storage tanks and the upper deck.

4. The method of claim 3, wherein the void space comprises a size and a shape capable of containing an amount of fluid having a weight that is approximately equal to the weight of the AER System.

5. The method of claim 3, wherein the ballast medium is located in the void space.

6. The method of claim 1, wherein the hull is assembled at a first location and the AER System is assembled at a second location, wherein the second location is different from the first location.

7. The method of claim 6, wherein the at-shore location is different from the first location and the second location.

8. The method of claim 1, wherein the at-shore location comprises a jetty, a quayside, or a shoreline.

9. The method of claim 1, wherein the at-shore location is selected from the group consisting of a jetty, a quayside, and a shoreline.

10. The method of claim 1, wherein the at-shore location comprises a position proximate to a shoreline location.

11. The method of claim 1, wherein the at-shore location is a position proximate to a shoreline location.

12. A method of manufacturing a water-based apparatus for liquefaction, wherein the water-based apparatus comprises a hull defining a bow, a stern, and a centerline axis extending from the bow to the stern and the water-based apparatus is configured to be moored to an at-shore location, the method comprising:

providing a structure to contain a plurality of LNG storage tanks in the hull and below an upper deck of the hull so as to create a void space between the plurality of LNG storage tanks and the upper deck;

determining a weight of an AER System;

locating a ballast medium in the void space, the ballast medium having a simulated weight approximate to the weight of the AER System;

determining a deflection of the hull caused by the simulated weight; and moving the ballast medium off the void space while attaching the AER System to the hull so that the weight of the ballast medium supported by the hull is reduced in proportion to the simulated weight applied by the AER System in order to maintain the deflection of the hull while the AER System is attached.

13. The method of claim 12, wherein the AER System is configured to (i) receive electricity and feed gas from an external source, wherein the external source is separate from the water-based apparatus, (ii) perform a refrigeration process for converting the feed gas into LNG with the electricity from the external source using a plurality of electrically-driven compressors and a cryogenic heat exchanger operatively configured on the water-based apparatus, (iii) discharge substantially all thermal energy from the refrigeration process to ambient air with air coolers and (iv) output the LNG.

14. The method of claim 12, wherein the void space is sized and shaped to be capable of containing an amount of fluid having a weight that is approximately equal to the weight of the AER System.

15. The method of claim 12, wherein the deflection of the hull is maintained by incrementally releasing the ballast medium while attaching the AER System.

16. The method of claim 12, wherein the hull is assembled at a first location and the AER System is assembled at a second location, wherein the second location is different from the first location.

17. The method of claim 16, further comprising moving the hull having the AER System attached to the at-shore location different from the first location and the second location.

18. The method of claim 12, wherein the LNG storage tanks are spaced apart in a single row along the centerline axis of the hull.

19. A method of manufacturing a water-based apparatus for at-shore liquefaction, the method comprising:

receiving a hull assembled at a first location, wherein the received hull includes a plurality of LNG storage tanks assembled in the hull;

assembling an AER Module at a second location different from the first location;

locating a ballast fluid in a void space above the plurality of LNG storage tanks to obtain a deflection at the second location;

maintaining the deflection by incrementally releasing the ballast fluid while attaching the AER Module at the second location so that a weight applied by the ballast fluid is reduced in proportion to a weight applied by the AER Module;

attaching the AER Module to an upper deck of the hull at the second location;

testing systems of the AER Module and the hull at the second location; and moving the hull to an at-shore location different from the first location and the second location.

20. The method of claim 19, wherein the AER Module is configured to (i) receive electricity and feed gas from an external source, wherein the external source is separate from the water-based apparatus, (ii) perform a refrigeration process for converting the feed gas into LNG with the electricity from the external source using a plurality of electrically-driven compressors and a cryogenic heat exchanger operatively configured on the water-based apparatus, (iii) discharge substantially all thermal energy from the refrigeration process to ambient air with air coolers and (iv) output the LNG.

21. The method of claim 19, wherein the deflection is a deflection of the upper deck of the hull.

22. The method of claim 19, the void space comprises a size and a shape capable of containing an amount of fluid having a weight that is approximately equal to the weight of the AER Module.

23. The method of claim 19, wherein the LNG storage tanks are spaced apart in a single row along a centerline axis of the hull, wherein the centerline axis extends from a bow of the hull to a stern of the hull.

24. A method of manufacturing an at-shore water-based apparatus for liquefaction of natural gas, wherein the water-based apparatus comprises a hull defining a bow, a stern, and a centerline axis extending from the bow to the stern and the water-based apparatus is configured to be moored to an at-shore location, the method comprising:

determining a weight of an AER System;

providing a structure for a plurality of LNG storage tanks that are spaced apart in a single row along the centerline axis of the hull, wherein top surfaces of the LNG storage tanks are spaced apart from an upper deck to define a void space, wherein the void space is sized and shaped to be capable of containing an amount of fluid having a weight that is approximately equal to the weight of the AER System;

determining a deflection of the upper deck caused by the weight of the AER System;

locating a ballast medium in the void space, the ballast medium having a simulated weight approximate to the weight of the AER System;

moving the ballast medium off the void space while attaching the AER System to the upper deck so that the weight of the ballast medium is reduced in proportion to the weight applied by the AER System in order to maintain the deflection of the upper deck while the AER System is attached;

assembling the plurality of LNG storage tanks in the hull; and coupling the AER System with the LNG storage tanks, wherein the LNG storage tanks are operatively configured to receive the LNG from the AER System and operatively configured to output the LNG to an LNG transport vessel that is separate from the water-based apparatus.

25. The method of claim 24, wherein the AER System is configured to (i) receive electricity and feed gas from an external source, wherein the external source is separate from the water-based apparatus, (ii) perform a refrigeration process for converting the feed gas into LNG with the electricity from the external source using a plurality of electrically-driven compressors and a cryogenic heat exchanger operatively configured on the water-based apparatus, (iii) discharge substantially all thermal energy from the refrigeration process to ambient air with air coolers, and (iv) output the LNG.

26. The method of claim 24, wherein the AER System comprises a first refrigeration train and a second refrigeration train where a substantial portion of the first refrigeration train is aft of a mid-ship axis of the hull and a substantial portion of the second refrigeration train is forward of the mid-ship axis such that a weight of the first refrigeration train is balanced against a weight of the second refrigeration train about the mid-ship axis.

27. The method of claim 24, further comprising attaching a support frame of the AER System to a plurality of support structures of the hull such that the weight of the AER System is supported by the plurality of support structures.

28. The method of claim 24, wherein the hull is assembled at a first location, and the AER System is assembled at a second location and is attached to the hull at the second location, wherein the second location is different from the first location.

29. The method of claim 28, further comprising moving the hull having the AER System attached to the at-shore location different from the first location and the second location.

* * * * *